US009449736B2

(12) United States Patent
Koslow et al.

(10) Patent No.: US 9,449,736 B2
(45) Date of Patent: Sep. 20, 2016

(54) HIGH DIELECTRIC COMPOSITIONS FOR PARTICLE FORMATION AND METHODS OF FORMING PARTICLES USING SAME

(71) Applicant: GABAE Technologies, LLC, Dallas, TX (US)

(72) Inventors: Evan Koslow, Dallas, TX (US); Jocelyn Tindale, Cambridge (CA); Ryan Gerakopulos, Waterloo (CA); Tatiana Lazareva, Waterloo (CA); Angela Kim, Toronto (CA); Chitral Angammana, Guelph (CA)

(73) Assignee: Gabae Technologies LLC, Carson City, NV (US)

( * ) Notice: Subject to any disclaimer, the term of this patent is extended or adjusted under 35 U.S.C. 154(b) by 0 days.

(21) Appl. No.: 14/177,984

(22) Filed: Feb. 11, 2014

(65) Prior Publication Data

US 2014/0350151 A1 Nov. 27, 2014

Related U.S. Application Data

(60) Provisional application No. 61/826,003, filed on May 21, 2013.

(51) Int. Cl.

| | |
|---|---|
| ***H01B 3/44*** | (2006.01) |
| ***H01B 3/30*** | (2006.01) |
| ***D01D 5/00*** | (2006.01) |
| ***B05B 5/025*** | (2006.01) |
| ***B05B 5/04*** | (2006.01) |
| ***D01D 5/098*** | (2006.01) |
| ***D01D 5/14*** | (2006.01) |
| ***D01D 5/18*** | (2006.01) |
| ***D01F 1/02*** | (2006.01) |
| ***D01F 1/10*** | (2006.01) |
| ***B05B 5/16*** | (2006.01) |
| *D01F 6/32* | (2006.01) |
| *D01F 6/62* | (2006.01) |
| *D01F 6/64* | (2006.01) |
| *D01F 6/70* | (2006.01) |

(52) U.S. Cl.

CPC ..... *H01B 3/445* (2013.01); *B05B 5/0255* (2013.01); *B05B 5/04* (2013.01); *B05B 5/1608* (2013.01); *D01D 5/003* (2013.01); *D01D 5/0092* (2013.01); *D01D 5/0985* (2013.01); *D01D 5/14* (2013.01); *D01D 5/18* (2013.01); *D01F 1/02* (2013.01); *D01F 1/10* (2013.01); *H01B 3/307* (2013.01); *D01F 6/32* (2013.01); *D01F 6/625* (2013.01); *D01F 6/64* (2013.01); *D01F 6/70* (2013.01)

(58) Field of Classification Search

CPC ..... H01B 3/445; H01B 3/307; D01D 5/003
See application file for complete search history.

(56) References Cited

U.S. PATENT DOCUMENTS

| | | | | |
|---|---|---|---|---|
| 4,100,236 | A | 7/1978 | Gordon et al. | |
| 4,554,335 | A * | 11/1985 | Sakagami | C08F 214/18 361/317 |
| 5,300,747 | A | 4/1994 | Simon | |
| 6,162,752 | A * | 12/2000 | Kawamoto | B82Y 30/00 252/62.3 BT |
| 7,498,082 | B2 | 3/2009 | Ito et al. | |
| 7,901,610 | B2 | 3/2011 | Joo et al. | |
| 2003/0215606 | A1 | 11/2003 | Clancy et al. | |
| 2004/0119045 | A1 | 6/2004 | Hata | |
| 2008/0242171 | A1 | 10/2008 | Huang et al. | |
| 2009/0032475 | A1 | 2/2009 | Ferrer et al. | |
| 2009/0130301 | A1 | 5/2009 | Bahnmuller et al. | |
| 2009/0281224 | A1 | 11/2009 | Koh et al. | |
| 2010/0041804 | A1 | 2/2010 | Brands et al. | |
| 2010/0181707 | A1 | 7/2010 | Chao et al. | |
| 2010/0202100 | A1 | 8/2010 | Koh et al. | |
| 2012/0004370 | A1 | 1/2012 | Scott et al. | |
| 2012/0056342 | A1 | 3/2012 | Koslow | |
| 2013/0085212 | A1* | 4/2013 | Lagaron Cabello | C08K 11/00 524/35 |
| 2014/0094551 | A1 | 4/2014 | Koslow et al. | |
| 2014/0103554 | A1 | 4/2014 | Koslow et al. | |
| 2014/0168857 | A1 | 6/2014 | Sautter et al. | |

FOREIGN PATENT DOCUMENTS

| | | | |
|---|---|---|---|
| CN | 102031586 | | 4/2011 |
| EP | 0053242 | A1 | 6/1982 |
| JP | 59104911 | | 6/1984 |
| JP | 59104911 | A | 6/1984 |
| JP | 04145145 | A * | 5/1992 |
| JP | 2010121050 | A | 6/2010 |
| JP | 2010229563 | A | 10/2010 |
| KR | 100871440 | B1 | 11/2008 |
| WO | 2006069205 | A1 | 6/2006 |
| WO | 2009127170 | A2 | 10/2009 |

(Continued)

OTHER PUBLICATIONS

Kuzel et al., Multi-component polymeric composites, Synthetic Metals 67 (1994) 255-261.

(Continued)

*Primary Examiner* — Robert Harlan

(74) *Attorney, Agent, or Firm* — Phillips Lytle LLP; David L. Principe

(57) ABSTRACT

A high dielectric contrast composition for particle formation that includes a high dielectric solvent, and a polymer dissolved into the high dielectric solvent. A method of forming particles including dissolving a polymer in a high dielectric solvent to form a high dielectric composition, and dielectrophoretically spinning the high dielectric composition in an electric field to form particles.

11 Claims, 3 Drawing Sheets

(56) References Cited

FOREIGN PATENT DOCUMENTS

| | | | |
|---|---|---|---|
| WO | 2009140381 | A1 | 11/2009 |
| WO | 2010023449 | A1 | 3/2010 |
| WO | 2010105329 | A1 | 9/2010 |
| WO | 2012013167 | A2 | 2/2012 |
| WO | 2012122485 | A2 | 9/2012 |

OTHER PUBLICATIONS

Dalton et al., Electrospinning of polymer melts: Phenomenological observations, Polymer 48 (2007) 6823-6833.
Zhou et al., The thermal effects on electrospinning of polylactic acid melts, Polymer 47 (2006) 7497-7505.
Melnik et al., Features of spinning of modified polypropylene fibres, Fibre Chemistry, vol. 40, No. 5, 2008.
Psarreas et al., Nitroxide-Mediated Controlled Degradation of Polypropylene, Polymer Engineering and Science—2007, 2118-2123.
Rangkupan et al., Electrospinning Process of Molten Polypropylene in Vacuum, Journal of Metals, Materials and Minerals. vol. 12 No. 2 pp. 81-87, 2003.
Scorah et al., Peroxide-Controlled degradation of polypropylene using a tetra-functional initiator, Polymer Engineering and Science—2009, 1760-1766.
Shin et al., Experimental characterization of electrospinning: the electrically forced jet and instabilities, Polymer 42 (2001) 9955-9967.
Warner et al., Cost effective nanofiber formation: Melt Electrospinning, National Textile Center Annual Report: Nov. 2006.
Kang et al., Effect of dysprosium oxide addition on the microstructure and dielectric properties of BaTiO3 Ceramics, Electronic Materials Letters, vol. 6, No. 4 (2010), pp. 145-149, Dec. 2010.
Agarwal et al., Determination of dielectric constant of stearic acid films using varying gap immersion method, Electrocomponent Science and Technology, 1977, vol. 4, pp. 23-28.
Kim et al., Microstructural evolution of electrically activated polypropylene/layered silicate nanocomposites investigated by in situ synchroton wide-angle X-ray scattering and dielectric relaxation analysis, Polymer 47 (2006) 5938-5945.
Erisken et al., a hybrid twin screw extrusion/electrospinning method to process nanoparticle-incorporated electrospun nanofibres, Nanotechnology 19 (2008) 165302 (8pp), Mar. 2008.
Lee et al., Highly oriented electrospun polycaprolactone micro/nanofibers prepared by a field-controllable electrode and rotating collector, Springer-Verlag, 2009.
Schneider, Optimizing mechanical properties of polypropylene fibers and nonwoven through a novel vis-breaking technology, Ciba Specialty Chemicals Inc., CH-4002 Basel, Switzerland.
Polyglycerols—General Overview, Solvay Chemicals, Bruxelles—Belgium, Sep. 2008.
Nayak et al., Characterisation of Polypropylene (PP) nanofibres fabricated by melt electrospinning and meltblowing, Symposium 5, Syntheses and Chemistry of Polymer Nanocomposites, Environmentally Friendly Materials and Polymer Recycling, Victoria, Australia.
Yee et al., Stress-induced structural changes in electrospun polyvinylidene difluoride nanofibers collected using a modified rotating disk, Polymer 49 (2008) 4196-4203.
Kariduranganavar et al., Using an additive to control the electrospinning of fibres of poly (e-caprolactone), Wiley Interscience, Mar. 2010.
Database Thompson Scientific, 2004.
DuPont Tedlar Polyvinyl Fluoride Film, Oct. 1995.
JP2010121050A, English Abstract.
Database WPI Week 200935 Thomason Scientific, London, GB; AN 009-F08014 XP002754827 & KR100871440B1, Amo Co Ltd, Dec. 3, 2008, Abstract.

* cited by examiner

HIGH DIELECTRIC COMPOSITIONS FOR PARTICLE FORMATION AND METHODS OF FORMING PARTICLES USING SAME

RELATED APPLICATIONS

This application claims the benefit of U.S. Provisional 61/826,003 filed May 21, 2013, the entire contents of which are hereby incorporated by reference herein for all purposes.

TECHNICAL FIELD

Embodiments herein relate generally to particle formation, and more particularly to high-dielectric compositions for particle formation, and methods of forming particles using such compositions.

DETAILED DESCRIPTION

Figure 1:
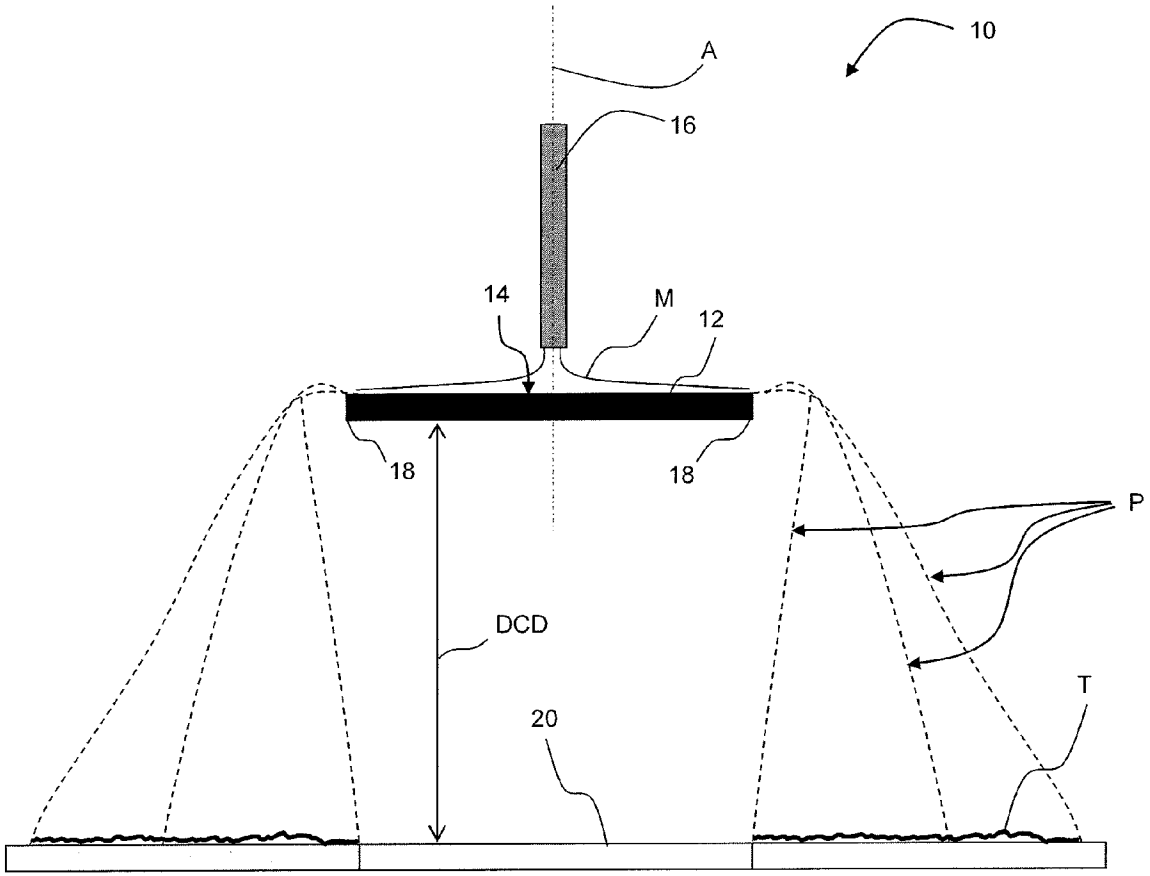
FIG. 1 is a schematic diagram illustrating a side view of an apparatus for forming particles according to one embodiment.

As discussed herein, various experiments have been conducted to examine the suitability of different compositions when forming particles, particularly sub-micronic polymer fibers.

In general, the term "particles" as used herein includes fibers (e.g., filaments, ligaments, etc.), droplets, and other shapes made from any suitable liquid and which may at least partially solidify, evaporate, and/or in some cases remain at least partially in liquid form.

"Electrospinning" as used conventionally refers to the production of particles (e.g., fibers or droplets) that are "spun" as fibers or "sprayed" as droplets by applying high electric fields to one or more fluid spraying or spinning tips (also called emitters or spinnerets).

During electrospinning, the sprayed droplets or spun fibers are typically collected on a target substrate or collector plate positioned away from the emitters. A high voltage supply provides an electric potential difference (and hence the electrostatic field) between the emitter (usually at a high voltage) and the target substrate (usually grounded).

It is often desirable to produce particles of very small sizes, particularly particles having a diameter less than 1 micrometer (i.e., sub-micronic fibers), since such particles can be commercially quite valuable. Theoretically this should be possible with known electrospinning processes based on results that have been achieved in a laboratory environment. However, in practice, scaling up an electrospinning process beyond the laboratory has proven to be problematic, particularly when trying to produce large quantities of very small particles.

Scott et al. in US Patent Application Publication No. 2012/0004370 describe the use of a low dielectric constant polymer dissolved in a low dielectric constant solvent. For the purposes of this application, this will be referred to as a "low dielectric contrast system" where the bulk constituents (polymer and solvent) have similar and low dielectric constants. The low dielectric constant solvent is supplemented with high dielectric additives to create a mixture with an overall high dielectric property and responsive to an electric field (i.e., the additives provide the elevated dielectric property). These low dielectric contrast mixtures display relatively good fiber formation when released into a strong electric field. The mixtures generally had a low conductivity that was below the range of conductivity usually associated with electrospinning. However, while the rates of fiber production seem high by conventional standards, they were still low when compared to desired commercial production rates.

Koslow et al. in U.S. Provisional Patent Application No. 61/682,894 filed on Aug. 14, 2012 describe methods of forming particles in which a strong force (centripetal or viscous drag forces) are used to convert a polymer melt into a pre-particle consisting of a relatively large filament of (in some cases) 10-30 micrometers in diameter. The mixture includes a base polymer compound and a dielectric additive having an elevated dielectric constant dispersed therein. The pre-particles are subjected to an electrostatic field to further attenuate the pre-particles and form particles of a desired size. What Koslow demonstrates here is that dielectrophoretic spinning is possible if a pre-particle is made available. This is important because unlike electrospinning, it is often very difficult to cause a fiber to emerge from bulk liquid as a result of the formation of a conventional Taylor cone. Once the pre-particle is created, the dielectrophoretic force is efficient to perform further attenuation of the particle with minimal applied electric energy. The entire contents of this application are incorporated by reference herein for all purposes.

Koslow et al. in U.S. Provisional Patent Application No. 61/713,000 filed on Oct. 12, 2012 describe a dielectrophoretic spinning process in which compositions include a polymer dissolved in a solvent with a much higher dielectric constant. These compositions seem to be particularly suitable for generating particles of small size at good production rates, especially in the case when the polymer itself has an elevated dielectric constant. Furthermore, the presence of one or more high-dielectric additives within the polymer/solvent mixture appear to help further reduce the size of the resulting particles. The entire contents of this application are incorporated by reference herein for all purposes.

The teachings herein are generally directed at further techniques that may be useful for increasing particle production rates, or reducing particle sizes, or both. The phenomenon called dielectrophoretic spinning (or "D-spinning") is discussed, which generally refers to a process in which the properties of a composition (particularly its dielectric properties) are selected to encourage the formation of very small particles through "dielectrophoretic attenuation", namely by action of the dielectrophoretic forces acting on the composition (and which are generally unrelated to the conductivity of the composition). In some cases, dielectrophoretic spinning may actually be improved where the conductivity of the composition is low, as this may enhance the power available for dielectrophoretic forces.

It has been discovered that dielectrophoretic spinning can generate relatively small particles at relatively large production rates when the composition includes a polymer of high dielectric constant dissolved into a solvent that has a high dielectric constant (sometimes in the presence of high dielectric additives). Polymers with a low dielectric constant can also be used if the solvent and additives have much higher dielectric constants. However, when the solvent and the polymer have widely varying dielectric properties, this often means that they are not compatible and one will not dissolve in the other. The present application may be beneficial at addressing this problem and in fact, it was surprisingly discovered that it appears that this incompatibility can be turned to advantage. In summary, the dielectric constant of the solvent is higher, and when possible much higher, than the dielectric constant of the polymer, while the dielectric constant of the additives may be even higher (in some cases quite substantially higher).

The resulting compositions where the solvent/additive or additive have much higher dielectric constants than the polymer may be referred to herein as a "high dielectric contrast systems" and it is believed that these types of compositions are suitable for forming large quantities of small particles, particularly sub-micronic polymer fibers.

One problem with prior approaches is that high dielectric solvents will generally not dissolve or disperse polymers of much lower dielectric constant. Effectively, the Hansen Solubility Parameter for polarization of the two compounds are not similar. This usually means that the dispersive and hydrogen bonding parameters are also not matching. In the past, this failure to match has been considered a barrier to using any such mixtures for conventional electrospinning. That is, if the polymer does not dissolve in the solvent, the mixture was considered to be useless.

It has now been surprisingly discovered that this problem can be addressed by the use of a dispersant, by careful selection of the solvent, or by heating the mixture (or by some combination thereof). In some cases, as described herein when heating is severe and approaching or even exceeding the melting point of the polymer, these incompatible conditions can be resolved.

Notably, the fact that the solvent and polymer are incompatible appears to create an opportunity to obtain extremely high dielectric contrast between the polymer micelles (where the polymer is tightly coiled as a result of the remaining incompatibility with the surrounding solvent) and the surrounding solvent and additives. This micro-dispersion of the two phases with dramatically different dielectric properties creates the high dielectric contrast that can produce very good dielectrophoretic spinning results.

During a dielectrophoretic spinning process, it is desirable that the solvent be at least partially removed such that the finished polymer particles are normally substantially free of solvent. The mechanism for solvent removal in these systems is believed to be at least in part related to the ratio of the dielectric constants of the polymer and solvent as also amended by any additives.

Generally, it is understood that the dielectrophoretic forces acting upon an object increase by the square of the magnitude of the electric field gradient and in roughly direct proportion to the dielectric contrast of the dispersed phase vs. the dielectric constant of the continuous phase through an equation sometimes called the Pohl Equation.

Scott et al. have previously shown it may be possible to mechanically remove the solvent from the lower dielectric polymer phase using the dielectrophoretic differences between these two materials. Specifically, Scott et al. describe low dielectric constant polymers dissolved in low dielectric constant solvents that have been enhanced with high dielectric additives. The result can help drive physical separation of the solvent from the polymer due to differences in the dielectrophoretic forces acting on the different constituent parts. Scott et al. refer to this process as "solvent ejection". Note, however, that in the Scott system, the solvent and polymer had roughly similar dielectric constants as one could not dissolve the other if the difference was greater than some reasonable limit. In the Scott system it was the additives, therefore, that were the source of the strong spinning forces and solvent-ejecting forces.

However, it has been determined that the approach of Scott et al. may not be suitable when trying to generate large quantities of small particles. In particular, it has been observed that the dielectric contrast between the two main phases of the system—the solvent and the polymer—has a major influence on creating strong attenuation forces. Scott missed this because he was unable to create stable mixtures of high dielectric contrast. In fact, his mixtures are metastable and react to elevated atmospheric moisture or other conditions to precipitate. Scott's low dielectric contrast approach may thus be far less productive than the high dielectric contrast systems as described herein for example. In addition, the solvents usable in the Scott approach are limited to those that roughly match the Hansen Solubility Parameters of the polymer.

According to the present teachings, compositions where the solvent/additive or simply the additive added to the polymer have much higher dielectric properties than the polymer (i.e. where the solvent and polymer have dramatically different dielectric constants) provide much better results, especially in regard to the volume of fibers produced. Basically, dissolving the polymer in a solvent of similar dielectric constant has wasted a now discovered opportunity to build dielectric contrast and enhance the available spin forces.

It has in fact been observed that it is usually better to make large leaps in dielectric constant at each step and thereby build large dielectrophoretic forces efficiently. Using a base polymer with an elevated dielectric constant may also allow much higher spin rates.

The use of high dielectric compositions as described herein seems to result in higher production rates and in some cases production rates may be five, fifty or even many more times as high as other known electrospinning processes or the Scott teachings.

In general, the maximum rate of fiber production is believed to be roughly proportional to the dielectric constant of the polymer and the dielectric contrast of this polymer with the surrounding solvent/additive or additive. To build further contrast, one can build a "dielectric ladder" usually consisting of a candidate polymer of relatively low dielectric constant, dissolved or dispersed into a solvent with a much higher dielectric constant, wherein this mixture is further amended with one or more additives that are present in progressively smaller amounts, but have progressively higher and higher dielectric constants. Other ingredients might include a dispersant to enhance polymer dispersion within the mixture as well as surfactants to adjust surface tension or co-solvents to obtain lower viscosity.

In some embodiments, one or more high dielectric additives can be included within the solvent to further enhance the total effective dielectric contrast of the composition. In some such embodiments, the dielectric additives may have dielectric constants many times higher than the dielectric constants of either the solvent or the polymer, or both. In some specific instances, the dielectric constant of the additives may be above 100, 1000, 10,000, or even above 100,000.

In some embodiments, the solvent may include one or more of the following solvents: acetone, acetonitrile, acetophenone, acetyl chloride, acrylonitrile, gamma-butyrolectone, cyclohexanone, N,N-dimethylacetamide, N,N-dimethylformamide, dimethylsulfoxide, 1,4-Dioxane, ethylene glycol, ethyl formate, formamide, formic acid, methanol, methyl ethyl ketone, N-Methyl-2-pyrrolidone, nitromethane, 2-Nitropropane, propylene-1,2-carbonate, tetrahydrofuran, tetramethylurea, triethyl phosphate, and trimethyl phosphate. In general these and many other solvents have a high dielectric constant, and/or dissolve or swell particular polymers (e.g., polycarbonate, PVDF, styrene, polyesters, polyamides, polyacrylics, polyetherimides). In some cases, these solvents may requite elevated temperatures to accomplish the desired degree of dispersion.

In some specific embodiments, a high dielectric composition may not include any low dielectric components whatsoever. Such compositions may allow for production rates that are much higher (e.g., 5,000 to 100,000 times or more) than known electrospinning or the Scott technologies.

For example, the use of high dielectric compositions may yield sub-micronic fibres of very small diameter at rates of roughly 300-1,000 grams per minute per linear meter of beam. Traditional solvent-based electrospinning from a needle typically operates at flow rates of about 0.1-1.0 milliliter per hour and resulting in only a fraction of a gram of dry fibre per hour. In contrast, the current dielectrophoretic system in the same geometry might flow at up to 40 milliliters per hour and produce up to 8 grams per hour of dry 150-250 nanometer fiber (i.e., up to 400 times greater rates of production). However, when using a spinning rotor apparatus as shown and described herein, this production rate can be increased to 40 milliliters/minute of a solvent-based system, which is 24,000 times greater production. If the current system involves a molten polymer with a high dielectric contrast additive, the production rate of dry fiber from a single rotor can be up to 40 grams/minute, which is nearly 100,000 times greater than obtained from a traditional needle-based electrospinning emitter. Using a melt spray or melt blowing apparatus, this production rate can be further increased to greater than 1.00 Kg/minute, with spin rates of 0.5 grams/minute-hole being typical.

The use of high dielectric contrast systems may also have other advantages. For instance, some compositions can make use of highly polar compounds that are not strongly influenced by local temperature or humidity conditions during the spinning process. The resulting fibers and particles made using the current dielectrophoretic spinning can have high temperature resistance, high solvent resistance, can be extremely hydrophobic, and could in some cases be used to produce super-hydrophobic and oleophobic surfaces.

Moreover, such compositions may be generally nontoxic and of low flammability making them safe to handle during manufacturing. In fact, some particularly suitable solvents, if solvents are used, may be specifically selected for low vapor pressure even at elevated temperatures.

These compositions may also eliminate (or at least reduce) problems associated with orifice clogging and cleaning in conventional electrospinning equipment. Many of suitable solvents as generally described herein have extremely low vapor pressure at room temperature and do not significantly evaporate when exposed to the atmosphere. Such solvents would not be useful in electrospinning where the solvent must evaporate during fiber formation. When the solvent is instead mechanically eliminated during spinning by alternative means (mechanical ejection), the solvent can be selected for low vapor pressure, low flammability, low toxicity, and low cost. Clogging, typically caused by the premature evaporation of the solvent, which leaves polymer debris that clogs critical orifices, generally does not occur when the solvent has low vapor pressure.

In some cases, the resulting fibers or particles can be controlled and directed to a counter-electrode in a manner similar to electrostatic coating of paints. However, in many cases, dielectrophoretic spinning can be done in open air using a "monopolar" source where there is no immediately apparent counter electrode. In such cases, the fibers can be released into a surrounding airstream, entrained within this moving airstream, and collected onto a screen or wire in a manner similar to a common air laid process. There is often no need for elaborate fiber separation as the fibers are generally in the form of a loose cloud and the fibers often repel each other during their production and thus avoid forming agglomerates.

In one exemplary embodiment, poly(vinylidene difluoride) (PVDF) may be used as an example of a high dielectric polymer, with a dielectric constant of roughly 8-12 (in contrast, most polyolefins or polystyrene have significantly lower dielectric constants of roughly 2-3). The PVDF resin can be dissolved within a solvent system that includes one or more high dielectric solvents, such as dimethyl sulfoxide (DMSO) or other co-solvents. The solvent/polymer mixture can be further enhanced by the addition of a high dielectric additive, such as 50 nanometer barium titanate powder (with a dielectric constant of around 1750).

The resulting high dielectric composition can be fed through a glass pipette with a 1 mm orifice and having a submerged wire within the composition (sustained at a distance from the opening of the pipette) to apply an electric field to the fluid. Applying a voltage between this submerged electrode and a suitable counter electrode at a distance D from the opening of the pipette can result in particles that are attenuated into small (particularly sub-micronic) particles.

Figure 2:
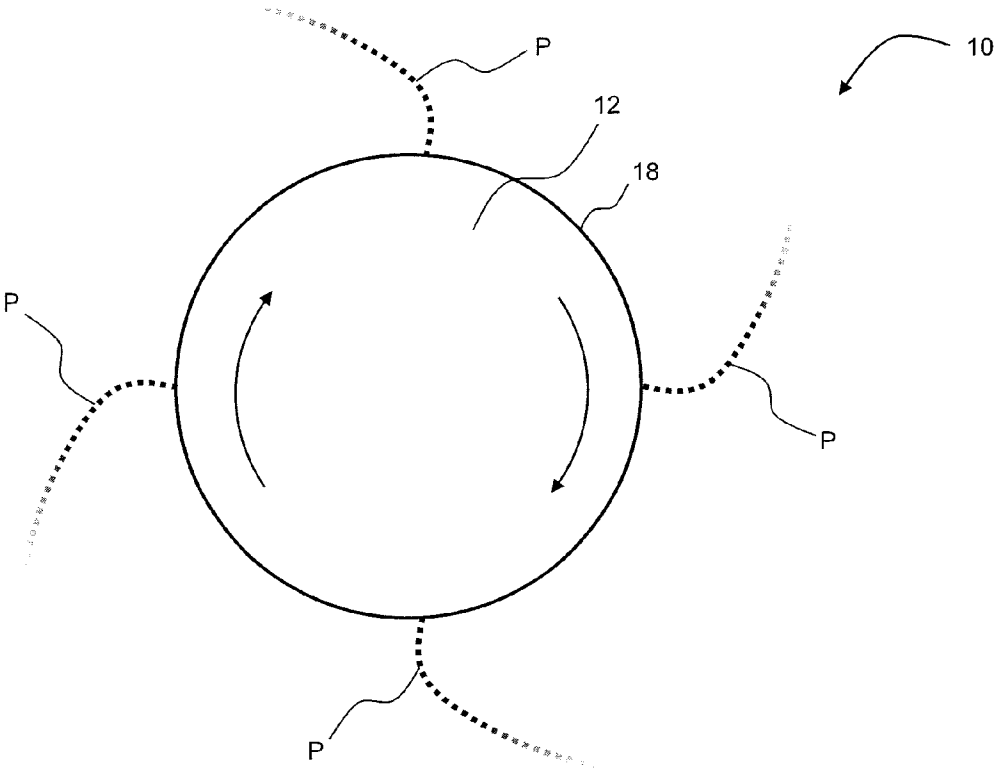
FIG. 2 is a top view of a rotating disk of the apparatus of FIG. 1.

Turning now to FIGS. 1 and 2, illustrated therein is a schematic representation of an apparatus 10 for forming particles using high dielectric contrast systems according to one embodiment.

The apparatus 10 generally includes at least one rotating surface, which in this embodiment is a rotating disk 12 with an upper surface 14. The apparatus 10 also includes a feed chamber or dispenser 16. As shown, the dispenser 16 is generally at or near the center of the disk 12 (e.g., at the axis of rotation A of the disk 12) and serves as a source for the liquid composition used to feed the rotating upper surface 14 of the apparatus 10.

In particular, a composition or mixture of high dielectric polymer and high dielectric solvent (indicated generally as M) may be deposited from the dispenser 16 onto the upper surface 14 of disk 12 generally at the axis of rotation A. The deposited mixture M will then flow outwardly across the disk surface 14 (generally as a thin film) due to the centrifugal forces generated by rotation of the disk 12.

Under the appropriate operating conditions (e.g., suitable rotational speeds, mixture feed rates, etc.), upon reaching the edge 18, the liquid mixture M will separate from the surface 14 of the disk 12 to form particles (indicated generally as P). These particles P may include fibers (e.g., filaments, ligaments, fibrils, etc.), droplets, or particles of various other shapes and sizes.

An electrostatic field is applied to these particles P to further attenuate them. For example, an electrostatic field may be generated between the disk 12 and a collector plate 20 positioned below the disk 12. Due to the electric field, and when the liquid mixture M has suitable properties, the particles P ejected from the disk 12 will further attenuate within the electric field so as to be further reduced in size.

For example, particles P may be ejected from the disk 12 with a size greater than one micron in diameter (e.g., greater than one micron but generally less than fifty microns), and then be further attenuated within the region surrounding the disk. The attenuation is caused by dielectrophoretic forces that drive fiber diameter down to less than one micron (in some cases, significantly less than one micron).

The particles P will normally be drawn down by the electrostatic field and deposit on a top surface of the collector plate 20, in some cases forming a particle mat T on the collector plate 20.

In some embodiments, an estimate of the electrostatic field strength for the apparatus 10 may be indirectly determined by a voltage-distance quotient, shown here as the disk-to-collector distance DCD between the collector plate 20 and the disk 12. However, this appears to be less important in dielectrophoretic spinning as these forces are the result of the non-uniform electric field gradient near the space where the fiber is formed. The presence of a counter-electrode may thus be almost unimportant. In fact, if this counter-electrode is eliminated, the process tends to continue unabated.

In some cases, hot air can be used to heat the disk 12 or dispenser 16 (or both) to maintain the mixture M in a desired liquid state and more particularly at a temperature and viscosity that encourages the formation of small and stable particles P that separate from the edge 18 of the disk 12. The application of heat is also a primary means to cause solvents and polymer mixtures to successfully operate together when this may be impossible at room temperature.

Figure 3:
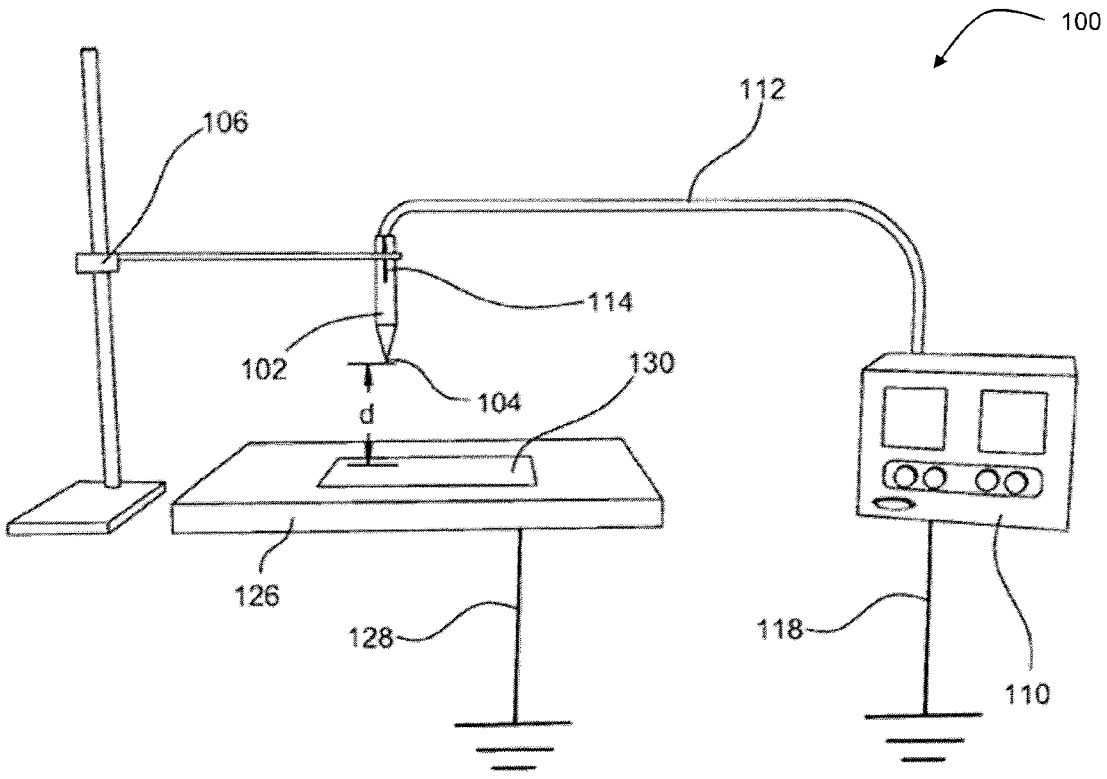
FIG. 3 is a schematic diagram illustrating an apparatus for forming particles according to another embodiment.

Turning now to FIG. 3, illustrated therein is another apparatus 100 for producing particles using a high dielectric composition according to another embodiment. The apparatus 100 generally includes a nozzle 102 (i.e., the emitter) with an orifice 104 at its distal end, and which is configured to emit the high dielectric contrast composition.

The nozzle 102 may be supported by an insulating stand 106 or other suitable structure that electrically isolates the nozzle 102 from its surroundings. In some embodiments, the nozzle 102 may be made from more electrically insulating materials such as glass, plastic, polytetrafluoroethylene (PTFE), nylon, or other suitable insulating material that is also chemically compatible with the high dielectric composition. In some embodiments, a conducting nozzle material may also be suitable.

In some cases, the nozzle 102 can act as a reservoir for the high dielectric composition, or can communicate with a fluid reservoir that stores the high dielectric composition. In some embodiments, multiple nozzles 102 can be employed concurrently although only one nozzle 102 is shown here for clarity.

In general, the orifice 104 can be configured so as to provide a suitable level of hydrodynamic resistance to the flow of the composition to obtain a desired composition feed rate.

In some embodiments, flow of fluid through the nozzle 102 can be driven by gravity (e.g., by arranging for a suitable fluid head above the nozzle orifice 104), or flow can be driven by a pump (e.g., a syringe pump) or other flow-regulating device. When dielectrophoretic forces are used, the fluid is drawn from the capillary by polarization in the electric gradient. This "pumping action" will draw the fluid from the capillary in a measured fashion and as described herein the flow rate actually moves by this natural pumping action.

Pumping is the result of a high dielectric fluid being drawn toward the region of highest field gradient. Under high-speed video examination, this pumping action can have a distinct high-frequency pulsation that is likely caused by the resonance resulting within the spin circuit where there is a resistance through the fluid and a capacitance for the surrounding electrodes. In the capillary tube apparatus, this RC resonance is often around 1000 Hz.

In some embodiments, a capillary tube (e.g., a PTFE capillary tube) can be inserted into the nozzle 102 so that one end of the capillary tube restricts the flow at the orifice 104 and the other end of the capillary tube communicates with the interior of the nozzle 102 or with a fluid reservoir. The dielectrophoretic forces experienced at the nozzle tip draw fluid out of the nozzle 102 and can therefore act as a pump. The smaller PTFE tube prevents excess fluid emerging as a result of gravity.

During use, a power supply 110 applies a voltage to the fluid composition, for example through an insulated or shielded cable 112 and an electrode 114 that may be immersed in the fluid composition (e.g., within the nozzle 102), usually at a significant distance from the orifice 104. This electrode can also be positioned near the fluid, but in open air, to induce polarization. The electrode can also be placed an extended distance away while immersed in the fluid. In one experiment, the electrode was placed approximately 40 feet away down a 0.25" I.D. plastic tube and the fluid successfully was spun from the other end of the tubing. This "spooky" capability to cause spinning through a good insulator at such a distance appears to be a characteristic of dielectrophoretic spinning.

During use, when a suitable fluid composition is exposed to a sufficient voltage, particles will be emitted from the orifice 104 and drawn down by an electrostatic field and deposited on a top surface of a collector plate 130. Generally as with the apparatus 10, dielectrophoretic forces acting on the particles will attenuate the particles down to a desired size, in some cases sub-micronic sizes.

The arrangement of the apparatus 100 illustrated in FIG. 3 includes a surface 126 that is grounded through a ground connection 128 that is not directly connected to ground connection 118 of the power supply 110. It will of course be appreciated that other configurations for the apparatus 100 are possible.

EXPERIMENTS

General Comments

As discussed in further detail below, various experiments were conducted by exposing different compositions to an electrostatic field and observing the resulting particle sizes. Specifically, experiments were conducted to observe the performance of several high dielectric contrast systems that included a high dielectric polymer such as poly(vinylidene difluoride-co-hexafluoropropylene) [P(VDF-HFP)] in the dielectrophoretic spinning processes. For simplicity, P(VDF-HFP) may simply be referred to herein as simply PVDF. Some of these experiments were performed using an apparatus generally similar to the apparatus 100 described with reference to FIG. 3 above using an applied voltage of −37.5 kV and a distance, d, of 9 cm.

A relative assessment of different dielectrophoretic spinning experiments was performed by comparing observed results (e.g., fiber output measured in grams per hour (g/h), fiber size, the nature and/or characteristics of particle formation, etc.).

In some cases, a composition with high dielectric materials may be considered to be relatively more effective at producing fibers if the resulting fiber output (i.e. as measured in grams/hour) is greater, or the fiber size is generally smaller than that obtained from another composition, or both.

It was believed that PVDF would perform well in the presence of an electrostatic field since PVDF has a relatively high dielectric constant for a polymer and thus should be highly influenced by dielectrophoretic forces. Specifically, the dielectric constant $\in_r$ for PVDF is between about 8 and 12.

As discussed, the PVDF was dissolved in a high dielectric constant solvent that included at least some dimethyl sulfoxide (DMSO). DMSO is an effective solvent that dissolves a wide variety of chemical compounds, including PVDF. DMSO also has a low toxicity and is not flammable. DMSO also has a relatively high dielectric constant ($\in_r \approx 47$), which suggests that it would be highly influenced by dielectrophoretic forces according to the theories as generally described herein.

Initial experiments were aimed at determining if a composition that included PVDF dissolved in DMSO would be suitable to achieve good particle sizes and production rates.

Subsequent experiments then looked at whether the introduction of high dielectric additives, such as barium titanate ($BaTiO_3$, $\in_r \approx 1750$) would improve the results (e.g., higher fiber output, smaller fiber size, etc.)

Additional experiments with other solvents, surfactants, and variations in the percentages of PVDF were also undertaken to investigate the effect of varying dielectric constants, viscosity, surface tension, fiber diameter, fiber output, and formation of sprays, droplets, and/or wet fibers.

For reference, Table 1 lists various substances discussed herein, along with their associated dielectric constants, vapor pressures, and boiling points.

| Substance | Dielectric Constant | Vapor Pressure (mm · Hg) | Boiling Point (° C.) |
|---|---|---|---|
| DMSO | 47 | 0.084 | 189 |
| Acetone | 21 | 30.8 | 56 |
| methyl ethyl ketone (MEK) | 19 | 12.9 | 80 |
| butyl acetate (BuAc) | 5 | 1.66 | 126 |
| iso-propyl acetate (i-PrAc) | ~6 | 7.88 | 88 |
| water ($H_2O$) | 80 | 3.17 | 100 |
| Polyglycerol-3 | 30 | (low) | (higher than 100) |
| $BaTiO_3$, | 1750 | — | — |

Experiment 1

A K2850-04 in DMSO Solution

In a first experiment, four tests (1a through 1d) were conducted using a P(VDF-HFP) co-polymer called K2850-04 dissolved in a DMSO solution. K2850-04 is a Kynar Flex product produced by Arkema Inc. (King of Prussia, Pa., USA).

The concentration of K2850-04 was increased from 15 wt % to 21 wt % in increments of 2%. Fibers were obtained from each test, and observations are presented in Table 2:

TABLE 2

K2850-04 in DMSO solution

| Test ID | Composition | Average Fiber Diameter [nm] |
|---|---|---|
| 1a | 15% K2850-04<br>85% DMSO | 245 ± 96 |
| 1b | 17% K2850-04<br>83% DMSO | 329 ± 111 |
| 1c | 19% K2850-04<br>81% DMSO | 410 ± 117 |
| 1d | 21% K2850-04<br>79% DMSO | n/a |

A significant amount of wet spray was observed for the first test, and the fibers that did form contained "beads-on-a-string" formations. For the tests reported in experiment 1, poor fiber quality resulted in an inability to quantify the fiber output. The K2850-04 concentration was then increased to 17 wt % in an attempt to increase the viscosity of the solution and eliminate bead formation. The qualitative fiber output and amount of spray was similar with 15 wt % K2850-04, although the K2850-04 crystallized more readily making the mixture more difficult to handle.

Increasing the K2850-04 concentration to 19 wt % resulted in a lower fiber output and produced more droplets and spray.

The formulation with 21 wt % K2850-04 resulted in no fibers visible to the eye. The 21 wt % K2850-04 formulation was too viscous to spin well and also crystallized easily and quickly. Qualitatively, the fiber output was lower and there was more spray than for the formulation with 19 wt % K2850-04. Furthermore, the increase in K2850-04 above 19 wt % did not eliminate the formation of beads.

Experiment 2

Solution with High-Dielectric $BaTiO_3$ Additive

For the second experiment, barium titanate ($BaTiO_3$) was added to the composition (0.5 wt %) as a high-dielectric additive. Four tests (2a through 2d) were conducted, with two tests 2a and 2b with a K2850-04 concentration of 15%. These resulting observations are presented in Table 3:

TABLE 3

Solution with high dielectric $BaTiO_3$ additive

| Test ID | Composition | Fiber Output (g/hr) | Average Fiber Diameter [nm] |
|---|---|---|---|
| 2a | 15% K2850-04<br>84.5% DMSO | 0.32 | 242 ± 145 |
| 2b | 15% K2850-04<br>84.5% DMSO<br>0.5% $BaTiO_3$ | 4.71 | 278 ± 95 |
| 2c | 17% K2850-04<br>82.5% DMSO<br>0.5% $BaTiO_3$ | n/a | 280 ± 68 |
| 2d | 19% K2850-04<br>80.% DMSO<br>0.5% $BaTiO_3$ | n/a | n/a |

The fiber output increased for a mixture with $BaTiO_3$ (2b) relative to the mixture without $BaTiO_3$ (1a), which is consistent with the very high dielectrophoretic forces that would be acting on the barium titanate particles. It was possible to remove the PTFE insert from the nozzle and increase the solution flow rate (2b) while preserving an average fiber size around 250 nm.

Of particular interest, the increased fiber output (2b) was high in comparison to the output observed in low dielectric spinning reported by Scott et al., which is believed to be correlated to the positive effects of the high dielectric constant of the PVDF polymer.

The K2850-04 concentration was increased in test 2c to determine the effect of increased resin loading.

At 17 wt % K2850-04, the viscosity increased slightly and qualitatively, and the fiber output dropped slightly.

Increasing the K2850-04 concentration up to 19 wt % (in test 2d) raised the viscosity sufficiently high such that that the solution was not spinnable and did not produce particles. Accordingly, a K2850-04 concentration of around 15 wt % to 17 wt % may be a good operating range for high dielectric compositions with DMSO and $BaTiO_3$ in some cases.

The $BaTiO_3$ also delays the time required for the K2850-04 to crystallize, which causes the mixture to change to a solid-like gel. The formation of the gel is reversible, and a liquid state is achievable by heating and stirring the mixture. This reversibility property is true for all formulations that follow.

Experiment 3

DMSO and Acetone Solvents

The third experiment included two tests, 3a and 3b, and involved dissolving the polymer in a solvent mixture that included both DMSO and acetone. The first test 3a was conducted without the high-dielectric additive, barium titanate $BaTiO_3$, while the second test 3b added the high-dielectric additive. Observations for this experiment are presented in Table 4:

TABLE 4

DMSO and Acetone Solvents

| Test ID | Composition | Fiber output (g/hr) | Average Fiber Diameter [nm] |
|---|---|---|---|
| 3a | 15% K2850-04<br>42.5% DMSO<br>42.5% Acetone | 2.89 | 1029 ± 335 |
| 3b | 18.46% K2850-04<br>48.75% DMSO<br>32.5% Acetone<br>0.29% $BaTiO_3$ | 5.64 | 708 ± 314 |

The addition of acetone, a solvent with a dielectric constant ($\in_r \approx 21$) less than DMSO ($\in_r \approx 47$) positively increased the fiber output and reduced the amount of spray produced during spinning. The reduction in spray may be attributable to the higher vapor pressure and lower boiling point of acetone in comparison to DMSO.

The increase in fiber output may be related to the addition of a dielectric material with a dielectric constant in between the dielectric constant of DMSO and PVDF. In addition, it is suspected that the addition of the moderate dielectric material also reduces the bulk viscosity of the mixture such that it improves the spinnability of the mixture.

However, one observed effect of adding acetone to the composition was a corresponding increase in fiber size. Thus, while the acetone helped eliminate beads, it also simultaneously appears to increase the fiber size. This may be due to the acetone evaporating early in the spinning process, resulting in increased viscosity of the composition prior to the formation of the fibers and thus reducing the amount of fiber attenuation. This may also be due to the composition having a lower overall dielectric constant, and thus being less affected by dielectrophoretic forces.

Acetone also further delays the time required for the K2850-04 to crystallize.

Experiment 4

DMSO and MEK Solvents

In an attempt to reduce the fiber size, but maintain the fiber output and maintain or further reduce the spray, other dielectric solvents were selected as alternatives to acetone in this experiment. The selected solvents have slightly higher boiling points and moderate vapor pressures, and are known to dissolve PVDF.

Methyl ethyl ketone (MEK) may be desirable since it has similar solvating properties as acetone and is less expensive than DMSO. Furthermore, the vapor pressure of MEK is lower and the boiling point is higher than acetone, which should result in a slower evaporation of MEK during the spinning process, culminating in fibers with a smaller diameter.

Experiment 4 included nine tests, 4a through 4i, using a solvent mixture that combined DMSO and MEK. For the first test 4a, no $BaTiO_3$ was used. For tests 4b through 4f, concentrations of K2850-04 and $BaTiO_3$ were held somewhat constant while concentrations of DMSO and MEK were varied. In the remaining tests, 4g through 4i, K2850-04 content was decreased. Observations for this experiment are presented in Table 5:

TABLE 5

DMSO and MEK Solvents

| Test ID | Composition | Fiber output (g/hr) | Average Fiber Diameter [nm] |
|---|---|---|---|
| 4a | 49.2% DMSO<br>32.8% MEK<br>18% PVDF | 3.8 | 597 ± 200 |
| 4b | 49.03% DMSO<br>32.68% MEK<br>18% K2850-04<br>0.29% $BaTiO_3$<br>(60:40 DMSO/MEK) | 5.75 | 800 ± 209 |
| 4c | 40.79% DMSO<br>40.79% MEK<br>18.13% K2850-04<br>0.29% $BaTiO_3$<br>(50:50 DMSO/MEK) | 3.86 | 949 ± 135 |
| 4d | 32.63% DMSO<br>48.95% MEK<br>18.13% K2850-04<br>0.29% $BaTiO_3$<br>(40:60 DMSO/MEK) | 6.48 | 720 ± 256 |
| 4e | 24.47% DMSO<br>57.11% MEK<br>18.13% K2850-04<br>0.29% $BaTiO_3$<br>(30:70 DMSO/MEK) | 7.16 | 877 ± 223 |
| 4f | 16.32% DMSO<br>65.27% MEK<br>18.13% K2850-04<br>0.29% $BaTiO_3$<br>(20:80 DMSO/MEK) | 4.32 | 940 ± 474 |

TABLE 5-continued

| DMSO and MEK Solvents | | | |
|---|---|---|---|
| Test ID | Composition | Fiber output (g/hr) | Average Fiber Diameter [nm] |
| 4g | 25.1% DMSO<br>58.6% MEK<br>16% K2850-04<br>0.3% $BaTiO_3$ | 1.492 | 449 ± 83 |
| 4h | 25.71% DMSO<br>59.99% MEK<br>14% K2850-04<br>0.3% $BaTiO_3$ | 2.376 | 467 ± 136 |
| 4i | 26.3% DMSO<br>61.4% MEK<br>12% K2850-04<br>0.3% $BaTiO_3$ | n/a | n/a |

In comparing the formulations without $BaTiO_3$, the MEK formulation of test 4a demonstrated a decrease in fiber diameter and an increase in fiber output in contrast to the corresponding acetone formulation of test 3a. The higher boiling point and lower vapor pressure of MEK may contribute to a reduction in evaporation during the early spinning stages and a lower viscosity solution that produces smaller diameter fibers. The lower viscosity may also lead to the slightly higher fiber output.

The addition of $BaTiO_3$ to the MEK mixture (test 4b) again resulted in an increase in fiber output, while the fiber diameter also decreased in comparison to the acetone formulation of test 3b.

The MEK/$BaTiO_3$ composition appeared to provide for good fiber production rates and good fiber sizes. Additional experiments (4d-4f) were carried out to determine if the DMSO concentration could be lowered to reduce the cost of the formulation and possibly further improve the spinning properties by having a higher concentration of more readily evaporative solvent in comparison to DMSO.

Once the DMSO concentration is lowered to 20:80 DMSO/MEK (test 4f), the spinning performance drops, perhaps because there is not a sufficient amount of DMSO present.

The fiber diameter does not seem to change dramatically with the increased amount of MEK. At elevated concentrations of MEK, porosity within the fiber itself emerges due to the phase separation of the polymer between the two solvents.

Decreasing the PVDF concentration from 18 (4e) to 14-16 (4g & 4h) wt % reduced the mixture viscosity and reduced the fiber size. A further reduction in PVDF concentration (4i) resulted in a mixture viscosity that was too low to support fiber formation.

Experiment 5

Alternatives to MEK and Acetone

A series of other alternative dielectric solvents (aside from MEK) were selected as other possible alternatives to acetone. The selected solvents had slightly higher boiling points and lower vapor pressures, and were known to dissolve or swell PVDF. The observations of Experiment 5 are provided in Table 6:

TABLE 6

| Alternatives to MEK and Acetone | | | |
|---|---|---|---|
| Test ID | Composition | Fiber output (g/hr) | Average Fiber Diameter [nm] |
| 5a | 49.03% DMSO<br>32.68% BuAc<br>18% K2850-04<br>0.29% $BaTiO_3$ | 2.83 | 406 ± 117 |
| 5b | 49.03% DMSO<br>32.68% i-PrAC<br>18% K2850-04<br>0.29% $BaTiO_3$ | 4.87 | 466 ± 171 |

The results reported in Table 6 suggests the lower vapor pressures of BuAc and i-PrAc result in less evaporation during spinning than MEK and as a result there is less viscosity change culminating in smaller diameter fibers. The lower dielectric constants of BuAc and i-PrAc likely limit the fiber production rate.

Experiment 6

Surfactants

In Experiment 6, a surfactant was added to the composition to determine if the beads on the fiber could be eliminated or at least reduced by reducing the surface tension of the mixture.

It was also theorized that the addition of a surfactant might assist in stabilizing the dispersion of $BaTiO_3$, which might improve the fiber spinning properties. Two tests were conducted, 6a and 6b.

In the first test 6a, DMSO and acetone were combined as the solvent, and BDP-MB-1 produced by BDP Innovative Chemicals Inc. (Orlando, Fla., USA) was used with water as a surfactant.

In the second test 6b, DMSO, MEK, and BuAc were combined as the solvent, and $BaTiO_3$ was added, with Zephrym PD 2234-NV-LQ-(AP) (Zpm) (Croda International Plc, East Yorkshire, UK) as a surfactant. The observations are shown in Table 7:

TABLE 7

| Surfactants | | | |
|---|---|---|---|
| Test ID | Composition | Fiber output (g/hr) | Average Fiber Diameter [nm] |
| 6a | 47.1% DMSO<br>31.4% Acetone<br>18.1% K2850-04<br>1.2% BDP-MB-1 solids<br>1.8% $H_2O$ | n/a | 482 ± 116 |
| 6b | 12.24% DMSO<br>57.12% MEK<br>12.24% BuAc<br>18% K2850-04<br>0.3% $BaTiO_3$<br>0.1% Zpm | n/a | n/a |

It was noted that bead formation appeared to be eliminated in test 6a, perhaps due to a decrease in surface tension. The fiber output was qualitatively low in comparison to the acetone formulation without BDP. In addition, the conductivity of the mixture is increased when adding ionic surfactants, which may cause a loss of dielectrophoretic forces.

Experiment 7

Polyglycercol-3 Investigation

Polyglycerol-3 (PG-3) was introduced since it has a relatively high dielectric constant ($\in_r \approx 30$). A mixture with 5% PG-3 as shown in Table 8, produced fibers. The fiber output was quite high, comparable to the corresponding formulation without PG-3. However the fiber diameter increased significantly.

TABLE 8

Polyglycerol-3

| Test ID | Composition | Fiber Output (g/hr) | Average Fiber Diameter [nm] |
|---|---|---|---|
| 7a | 20% DMSO<br>56.7% MEK<br>5% PG-3<br>18% K2850-04<br>0.3% $BaTiO_3$ | 7.2 | 1487 ± 340 |

Additional Discussion

Based on the experiments conducted, several conclusions may be drawn.

It would appear a high dielectric polymer (K2850-04) dissolved in a high dielectric solvent (DMSO) does show promise in improving the production rates of small particles.

The addition of a high dielectric constant additive (e.g., ceramic $BaTiO_3$ nanoparticles) also appears to have positive effects on fiber output and production rates.

Adding a solvent with an intermediate dielectric constant (e.g., acetone) between the dielectric constants of the polymer (K2850-04) and main solvent (DMSO) may improve fiber output, but at the expense of fiber diameter.

It is believed that various other high dielectric additives could be suitable for improving particle production rates or decreasing particle sizes, or both. Examples of other dielectric materials that might be suitable as additives are listed in Table 10:

TABLE 9

Alternative Dielectric Additive Materials

| Material | Dielectric constant (approx.) |
|---|---|
| Ionic liquids | 10-15 |
| Polycaprolactone | |
| Polyglycerol | 30 |
| Glycerol | 40 |
| Calcium copper titanate (CCTO | 100,000-200,000 (approx.) |
| Lanthanum strontium nickelate nanopowder (<100 nm) | 100,000 (approx.) |
| Samarium oxides | >2500 |
| Lanthanum oxides | >2500 |
| Strontium oxide | >2500 |
| Nanopowders of metal, metal oxides, bi-metal oxides, multi-metal oxides | >100 |

TABLE 9-continued

Alternative Dielectric Additive Materials

| Material | Dielectric constant (approx.) |
|---|---|
| Titanium dioxide ($TiO_2$) | 86-173 |
| Core-shell nanoparticles | |
| Conjugated polymers | >20, possibly up to 100,000 |
| Liquid crystals | >100 |

It is also believed that various other polymers may have sufficiently high dielectric constants so as to be optimally suitable for the compositions and methods described herein. For example, polyurethane ($\in_r \approx 6.30$), phenolic ($\in_r \approx 6.50$-17.50), and Kynar (PVDF) ($\in_r \approx 8.4$), and Tedlar® PVF film, made by DuPont have high dielectric constants and may be suitable. In addition, vinylidene fluoride co- and ter-polymers have a very high dielectric constant ($\in_r \approx 10$-70).

Lower dielectric polymers can also be formulated to achieve similar results. However, as the polarity (dielectric constant) of the solvent becomes much larger than the polarity of the polymer, it is much more difficult to form a uniform mixture. In general, this limitation can be overcome by heating the mixture. This results in an expansion of the solvent compatibility by increasing the entropy of the system.

As described herein below, this approach can be taken to its logical extreme, with considerable success, by heating the mixture to a temperature approaching or even exceeding the melting point of the polymer. Under these conditions, even a polymer with a low dielectric constant can be dispersed into a high dielectric constant solvent to achieve a low viscosity and uniform mixture. In this case, the quantity of solvent can be reduced and the solvent's incompatibility with the polymer can be overcome.

In some embodiments, the high dielectric polymer could have a dielectric constant above 2, a dielectric constant above 5 and in some cases, a dielectric constant above 10.

In some embodiments, the high dielectric solvent could have a dielectric constant above 15, a dielectric constant above 30 or a dielectric constant above 45.

In some cases, the dielectric additive may have a dielectric constant above 65, above 1000 or above 100,000.

Material Qualification Investigations

Additional material qualification experiments were conducted using a nozzle-apparatus similar to the apparatus 100 as described above and as shown in FIG. 3.

Experiment 8

Homopolymer Vs. Co-Polymer PVDF

These experiments were conducted to determine how types of Poly (Vinylidene Difluoride) in the form of homopolymer (PVDF) and co-polymer (P(VDF-HFP)-Poly (Vinylidene Difluoride)-Hexafluoropropylene) would affect the physical properties of the solution and fibers produced by single nozzle spinning. Based on previous studies, a mixture of 18% Polymer, 0.3% Barium Titanate ($BaTiO_3$) as a high dielectric particle additive and two solvents (Dimethylsulfoxide (DMSO) and Methyl Ethyl Ketone (MEK)) were chosen as a baseline composition to produce fiber.

In attempts to spin dry fiber, some formulations were prepared with polymer concentrations slightly higher or lower than 18% to modify the viscosity of the solution. In some cases, to achieve the same goal, a PTFE (Polytetrafluoroethylene) insert was used in the spinning set-up to reduce flow rate of the mixture. The resulting data is presented in Table 10 and Table 11 below.

TABLE 10

Properties of the homo- and co-polymers of the PVDF

| Polymer | Dielectric Constant | Melt Flow Rate, g/10 min | Coefficient of Linear Thermal Expansion, 10E−5/° F. | Tensile Yield Elongation, % |
|---|---|---|---|---|
| K2850-04 P(VDFHFP) | 3.5-10.2 | 8.0-25.0 | 7.0-10.3 | 5-15 |
| K2821-00 P(VDFHFP) | 3.5-10.6 | 1.0-6.0 | 7.0-10.3 | 10-20 |
| Ultraflex BCRPB(VDF-HFP) | n/a | n/a | n/a | n/a |
| Flex 2751-00 P(VDF-HFP) | 3.8-12.1 | 4.0-14.0 | 9.0-12.0 | 15-25 |
| K711 PVDF | 4.5-9.5 | 19.0-35.0 | 6.6-8.0 | 5-10 |
| Superflex2501-20 P(VDF-HFP) | 4.5-13.5 | 2.0-14.0 | 8.5-10.8 | 17-25 |
| 20% K705 PVDF | 4.5-9.5 | 19.0-35.0 | 6.6-8.0 | 5-10 |
| 18% K705 PVDF | 4.5-9.5 | 19.0-35.0 | 6.6-8.0 | 5-10 |

TABLE 11

Results from Dielectrophoretic Spinning

| Sample Code | Composition | Fiber Output, g/hr | Viscosity, cP | Conductivity, μS/cm | Fiber Diameter, nm |
|---|---|---|---|---|---|
| 120813-AK-80-34-18C | 18% K2850-04 P(VDF-HFP)<br>0.29% BaTiO3<br>49.03% DMSO<br>32.68% MEK<br>(60:40 DMSO:MEK) | 5.75 | n/a | n/a | 800 ± 208 |
| 121016-JT-84-62-393a | 18% K711 PVDF<br>0.29% $BaTiO_3$<br>49.03% DMSO<br>32.68% MEK<br>(60:40 DMSO:MEK) | 8.57 | n/a | n/a | 697 ± 379 |
| 121016-JT-84-65-42b | 16% K2821-00 P(VDF-HFP)<br>0.29% $BaTiO_3$<br>50.23% DMSO<br>33.48% MEK<br>(60:40 DMSO:MEK) | 0.84 | n/a | n/a | 1212 ± 438 |
| 121016-JT-84-62-40 | 18% K705 PVDF<br>0.29% BaTiO3<br>49.03% DMSO<br>32.68% MEK<br>(60:40 DMSO:MEK) | n/a | n/a | n/a | 360 ± 168 |
| 121017-JT-84-65-43 | 20% K705 PVDF<br>0.29% $BaTiO_3$<br>47.83% DMSO<br>31.88% MEK<br>(60:40 DMSO:MEK) | 5.60 | n/a | n/a | 464 ± 347 |
| 121127-JT-88-10-72 | 18% Superflex 2501-20 P(VDF-HFP)<br>0.3% $BaTiO_3$<br>32.68% DMSO<br>49.02% MEK<br>(40:60 DMSO:MEK) | n/a | 78.45 | 5.97 | 501 ± 233 |
| 121127-JT-88-10-73 | 18% Ultraflex BCRB P(VDF-HFP)<br>0.3% $BaTiO_3$<br>32.68% DMSO<br>49.02% MEK<br>(40:60 DMSO:MEK) | n/a | 170.93 | 31.60 | 824 ± 193 |

TABLE 11-continued

| Results from Dielectrophoretic Spinning | | | | | |
|---|---|---|---|---|---|
| Sample Code | Composition | Fiber Output, g/hr | Viscosity, cP | Conductivity, μS/cm | Fiber Diameter, nm |
| 121127-JT-88-10-74 | 18% Flex 2751-00 P(VDF-HFP)<br>0.3% $BaTiO_3$<br>32.68% DMSO<br>49.02% MEK<br>(40:60 DMSO:MEK) | n/a | 176.30 | 11.90 | 806 ± 353 |

As can be seen from Table 11, all types of PVDF and (P(VDF-HFP)-based solutions were spinnable using the single nozzle set-up giving multiple powerful jets. Dripping and fine mist occurred for all investigated samples except sample 121127-JT-88-10-74 (also be referenced as sample 74, which is a reference to the last two digits of the sample code).

Considering the chemical structures of the different homo- and co-polymers of PVDF that were tested, the differences in the fiber size might be attributed to the branching of the polymer chain.

All investigated co-polymers (except Superflex 2501-20) tended to have larger fiber diameters in comparison with the homopolymer series (K711 and K705). It is believed that one ramification of the polymer chain is that this may lead to the solution having a higher viscosity, and hence some limitations with respect to how easily the mixture can be processed and the resulting fibers attenuated during dielectrophoretic spinning. As a result, the fibers tend to be larger.

This theory is in a good agreement with the polymer solution viscosity measurements and fiber spinning observations. Specifically, solutions prepared from the homopolymer type of PVDF (K711 and K705) were less viscous in comparison with the co-polymer solutions and gave smaller fiber diameters with better size uniformity.

The relationship between fiber size and viscosity of the polymer solution is noticeable from the comparison of samples with the same composition, but different homopolymer content. In particular, a higher percentage of the K705 leads to a higher viscosity the polymer solution, and results in larger fiber diameters with wider standard deviation.

The same trend was observed among the co-polymer P(VDF-HFP) solutions. In particular, samples were prepared from the different P(VDF-HFP) co-polymers, but using the same ratio of the formulations. The Ultraflex BCRPB(VDF-HFP) and Flex 2751-00 P(VDF-HFP) had very similar viscosities (170.93 cP and 176.30 cP, respectively), and had very similar fiber diameters: 824±193 nm and 806±353 nm, respectively. However, Superflex2501-20 P(VDF-HFP) had a lower viscosity (78.45 cP) and resulted in a smaller fiber size of only 501±233 nm.

Thus, PVDF in a homopolymer form may result in smaller fiber diameter due to lower viscosity of the solutions. However, in certain cases, such as when the solubility of some formulation components is an issue, the use of P(VDF-HFP) may also be beneficial. To modify the viscosity of the system and improve the morphology of the spun fibers, different additives may also be used as generally described herein.

Experiment 9

Surfactants

In some cases, the processability of a polymer solution may be an important characteristic, and it may be affected by different factors resulting in different fiber morphologies. In particular, fiber diameter may be a function of parameters such as flow rate, applied voltage, collecting distance, polymer structure and content, solvent properties, conductivity, viscosity, surface tension, and the properties of any fillers.

One of the major factors affecting the performance of polymer compositions is the surface tension of the system. The following experiments were designed to investigate the role of surfactants on the size and morphology of nanofibers.

The use of surfactants has arisen due to the use of different inorganic additives in polymer composites and the desire to avoid particle agglomeration and obtain even distribution of particles within a system. Surface functionalization of the additives using an appropriate surfactant or dispersant may also result in surface tension reduction (along with other effects). This reduction in surface tension may also improve particle distribution, impact electrical and rheological properties, and as a result may improve or discourage the spinnability of the composition. It is also believed that surfactants can be used to reduce fiber diameter by reducing the surface tension of the polymer in the solution. Surface tension is the primary force resisting the attenuation of the fluid. It is usually assumed that the smallest particle size that can be achieved is one where the attenuation force is balanced by the surface tension of the fluid.

In this experiment, (1-dodecyl)-trimethyl-ammonium bromide (DTMAB) was incorporated in the P(VDF-HFP) solutions to study the effect of solution surface tension on the fiber diameter. The resulting data is presented below in Table 12.

TABLE 12

| DTMAB Results | | | | |
|---|---|---|---|---|
| Sample Code | Composition | Viscosity, cP | Conductivity, μS/cm | Fiber Diameter, nm |
| 120814-AK-80- | 18% K2850-04 P(VDF-HFP) | n/a | n/a | 597 ± 200 |

TABLE 12-continued

| DTMAB Results | | | | |
|---|---|---|---|---|
| Sample Code | Composition | Viscosity, cP | Conductivity, μS/cm | Fiber Diameter, nm |
| 36-22A | 49.2% DMSO<br>32.8% MEK<br>(60:40 DMSO:MEK) | | | |
| 121122 TL-77-89-68 | 18% K2850-04 P(VDF-HFP)<br>0.5% DTMAB<br>32.6% DMSO<br>48.9% MEK<br>(40:60 DMSO:MEK) | 61.68 | 368 | 356 ± 47 |
| 120816-TL-77-30-28 | 18.13% K2850-04 P(VDF-HFP)<br>0.29% BaTiO3<br>32.63% DMSO<br>48.95% MEK<br>(40:60 DMSO:MEK) | 72.39 | 9.79 | 720 ± 256 |
| 121126-JT-88-5-70 | 18% K2850-04 P(VDF-HFP)<br>0.5% DTMAB<br>0.3% BaTiO3<br>32.48% DMSO<br>48.72% MEK<br>(40:60 DMSO:MEK) | 62.65 | 379 | 285 ± 48 |
| 121126-JT-88-5-71b | 18% K2850-04 P(VDF-HFP)<br>0.5% DTMAB<br>0.3% BaTiO3<br>32.48% DMSO<br>48.72% MEK<br>(40:60 DMSO:MEK) | 67.77 | 383 | 222 ± 64 |

The sample 120814-AK-80-36-22A (sample 22a) was prepared from K2850-04 P(VDF-HFP) (18%) and DMSO and MEK with no additives. The resulting fiber diameters were 597 nm±200 nm.

With a 0.5% DTMAB doping level (sample 68, 121122-TL-77-89-68) fiber diameter was reduced to 356±47 nm. The addition of the DTMAB surfactant appears to have decreased surface tension and viscosity (slightly), while resulting in a decrease in the fiber diameter.

Other factors (beyond surface tension and viscosity) may also play a role in reducing the fiber diameter when using this surfactant. For example, the presence of the surfactant within the air-fluid interface may reduce the solvent evaporation rate, thus extending jet stretching and allowing more time for fiber attenuation.

It is also notable that variance in the size of the fiber was improved. In particular, adding the DTMAB reduced the standard deviation from 200 nm to 47 nm.

Subsequently, additional experiments (samples 28, 70 and 71b) were performed to evaluate the effect of adding barium titanate ($BaTiO_3$) particles as a high dielectric additive on the fiber morphology.

To evaluate the effect of $BaTiO_3$ particles, samples 28 and 22A can be compared. As can be observed, there was no improvement in the fiber size when $BaTiO_3$ particles were added (and in fact, fiber diameter increased from 597±200 nm to 720±256 nm in the presence of $BaTiO_3$).

It is possible that the increase in the fiber size might be related to agglomeration of nanoparticles in this system. It was postulated that particle aggregation might be prevented by using a suitable surfactant to decrease surface free energy of the system and improve dispersion of the filler in the matrix. To evaluate this theory, $BaTiO_3$ particles were incorporated in the system in the presence of DTMAB (samples 70 and 71b).

The samples 70 and 71b have the same composition: 18% K2850-04 P(VDF-HFP)+0.5% DTMAB+0.3% $BaTiO_3$+32.48% DMSO+48.72% MEK, and the difference between these samples was how they were prepared. In particular, two different techniques for DTMAB incorporation were chosen to allow the surfactant to first adsorb either on the surface of $BaTiO_3$ particles (sample 70) or be first dissolved in the presence of the polymer (sample 71b).

For sample 70, the DMSO was split into 2 portions, one used to disperse $BaTiO_3$ and the second to dissolve DTMAB. In particular, the barium titanate was mixed with the DMSO and then sonicated for 35 min for better particle distribution within the solvent. The DTMAB was easily dissolved in the DMSO. These two compositions were then mixed together and stirred for 1 h at 70° C. It is believed that under this condition, DTMAB adsorption on the surface of $BaTiO_3$ will take place. In the meantime, P(VDF-HFP) pellets were mixed with MEK and stirred in an oil-bath at 70° C. Once the ($BaTiO_3$+DTMAB) solution was ready, the P(VDF-HFP) was almost fully dissolved in the MEK; the two solutions were then mixed together and stirred at 70° C. until homogenous.

For sample 71b, the DTMAB was mixed with MEK first, then heated at 70° C. to dissolve. Then, P(VDF-HFP) pellets were added while continuing stirring at 70° C. in the oil-bath until all P(VDF-HFP) was dissolved (which took approximately 1 h 20 min). In the meantime, $BaTiO_3$ powder was sonicated in DMSO for approximately 1 hour to get good distribution of particles in the solvent. These mixtures were then combined and stirred until homogenous, which took about 10 minutes.

As can be observed in Table 12, the presence of the $BaTiO_3$ and DTMAB together considerably reduced fiber diameter from 597 nm (sample 22A) to 285 nm (sample 70) and 222 nm (sample 71b). As such, it appears that the incorporation of $BaTiO_3$ particles had a positive influence on the fiber diameter reduction, which suggest that high dielectric $BaTiO_3$ may significantly improve dielectrophoretic spinning when used in the presence of surfactant.

In the case of sample 71b, the reduction in fiber size was somewhat stronger. This suggests that surfactant dispersion first with the polymer may play a useful role.

It is evident that the addition of the DTMAB surfactant reduced fiber size under all conditions. For example, for sample 22A (no surfactant, no $BaTiO_3$) and sample 68 (no $BaTiO_3$, but with surfactant), the fiber diameter dropped down from 597±200 nm to 356±47 nm. In light of the chemical structure of DTMAB, this drop may also be related to the changes of the crystallinity and morphology of the P(VDF-HFP) in the presence of surfactant.

In particular, P(VDF-HFP) as a copolymer is a semi-crystalline matrix, where the PVDF crystallizes partially. The crystalline phase appears mostly as a non-polar phase which will not interact (or is less reactive) with the solvent (in particular, the polarity indices of the DMSO and MEK are 7.2 and 4.7 respectively, as compared with the polarity index of water=10.2).

In the presence of DTMAB, the non-polar/crystalline phase may be greatly decreased in the P(VDF-HFP). This may make polymer-solvents interaction more attractive. As a result, different properties of the polymer (such as flexibility and elongation), as well as solvent evaporation during spinning may be improved. This appears to be supported by the collected data.

As for $BaTiO_3$ in sample 71b, having a more polar polymer surface should enhance the interaction of the polar $BaTiO_3$ particles with the polymer, which should enhance particle distribution within the mixture.

It should also be noted that pre-treatment of the $BaTiO_3$ with the surfactant did not seem to result in a better dispersion of the particles in the solution as was assumed (see sample 70), and particle agglomeration still took place. This might relate to incomplete disintegration of the initial $BaTiO_3$ powder before DTMAB adsorption. Considering the structure of DTMAB, adsorption of DTMAB on the surface of $BaTiO_3$ particles will expose non-polar "tails" of the DTMAB into the media. This may reduce the interaction and agglomeration of the particles. As a result, having agglomerates in the final mixture might relate to the treatment of the initial aggregates, but not single particles.

Other reasons for the formation of agglomerates in the system could relate to insufficient quantities of the surfactant to achieve adequate dispersion, or insufficiently strong coupling of the DTMAB with the $BaTiO_3$ surface. This might leave particles in the solution without any protection. Considering the small particle sizes involved (on the nanometer scale), such particles may be likely to experience agglomeration due to their high surface free energy.

In summary, the presence of high dielectric $BaTiO_3$ particles in the system and a modified polymer surface (using a surfactant) appears to result in a desired reduction on the fiber diameter.

Experiment 10

Ultra High Dielectric Constant Particles

In an attempt to confirm the effect of high dielectric constant additives on fiber diameter, a set of experiments using LSNO ($La_{1.6}Sr_{0.4}NiO_4$) nanoparticles (with a dielectric constant □~100,000) instead of $BaTiO_3$ (□~1,700) was performed.

The data obtained (Table 13 and Table 14 below) showed that replacement of $BaTiO_3$ (sample 18A) with the LSNO (sample 44c) in the same system considerably reduced the fiber size (from 717 nm±248 nm to 312 nm±73 nm) even without any surfactant in the mixture. Moreover, the flowability of the solution with the LSNO (sample 44c) was much higher in comparison with the mixtures with $BaTiO_3$ (sample 18A) and there is a complete elimination of particles and beads in the product fiber (sample 22B). In order to confirm that observed fiber diameter reduction relates to both the dielectric constant of the additive and its reduced impact on the viscosity of the system, the content of P(VDF-HFP) in the solution was varied while keeping the same ratio for the LSNO and solvents (see Table 14).

TABLE 13

LSNO As Dielectric Additive

| Sample Code | Composition | Fiber Output, g/hr | Fiber Diameter, nm |
|---|---|---|---|
| 120814-AK-80-36-22B | 18% K2850-04 P(VDF-HFP) 49.2% DMSO 32.8% MEK (60:40 DMSO:MEK) | 3.8 | 560 ± 173 |
| 120816-TL-77-30-18A | 18% K2850-04 P(VDF-HFP) 0.29% BaTiO3 49.03% DMSO 32.68% MEK (60:40 DMSO:MEK) | n/a | 717 ± 248 |
| 121019-JT-84-71-44c | 18% K2850-04 P(VDF-HFP) 0.29% LSNO 49.03% DMSO 32.68% MEK (60:40 DMSO:MEK) | 0.18 | 312 ± 73 |

TABLE 14

P(VDF-HFP) solutions with LSNO

| Sample Code | Composition | Fiber Output, g/hr | Fiber Diameter, nm |
|---|---|---|---|
| 121019-JT-84-71-44c | 18% K2850-04 P(VDF-HFP) 0.29% LSNO 49.03% DMSO 32.68% MEK (60:40 DMSO:MEK) | 0.18 | 312 ± 73 |
| 21019-JT-84-73-45b | 20% K2850-04 P(VDF-HFP) 0.29% LSNO 47.83% DMSO 31.88% MEK (60:40 DMSO:MEK) | n/a | 361 ± 59 |
| 121022-JT-84-73-46 | 24% K2850-04 P(VDF-HFP) 0.29% LSNO 45.43% DMSO 30.28% MEK (60:40 DMSO:MEK) | 1.848 | 926 ± 186 |

The results presented in Table 14 showed that increasing the polymer content from 18% to 20% and 24% led to a higher viscosity of the solutions. At the same time, fiber size increased considerably: from 312±73 to 926±186 nm. This suggests that viscosity of the solution is likely one of the main factors that contributed to the reduction in fiber diameter and variability.

Considering that LSNO has an enormously high dielectric constant in comparison with that of other components of the mixture, further studies of the effects of LSNO in the presence of $BaTiO_3$ were performed to make a "dielectric ladder" of the system more uniform.

Two different approaches were used to study synergetic effect of the LSNO and $BaTiO_3$ on the fiber diameter: either keeping 0.3% of each in the mixture (sample 52), or splitting a total 0.3% of high dielectric additive content equally between LSNO and $BaTiO_3$ (sample 53). For both scenarios two different set-ups were used to collect fibers, at 9 cm and 16 cm tip to collector distance. Results are presented in Table 15:

TABLE 15

LSNO with $BaTiO_3$

| Sample Code | Composition | Fiber Output, g/hr | Fiber Diameter, nm | Tip to Collector Distance, cm |
|---|---|---|---|---|
| 121024-TL-77-53-52a | 18% K2850-04 P(VDF-HFP) 0.3% LSNO 0.3% $BaTiO_3$ 48.84% MEK 32.56% DMSO (40:60 DMSO:MEK) | n/a | 586 ± 96 | 9 |
| 121024-TL-77-53-52c | 18% K2850-04 P(VDF-HFP) 0.3% LSNO 0.3% $BaTiO_3$ 48.84% MEK 32.56% DMSO (40:60 DMSO:MEK) | 0.84 | 640 ± 234 | 16 |
| 121024-TL-77-54-53a | 18% K2850-04 P(VDF-HFP) 0.15% LSNO 0.15% $BaTiO_3$ 32.68% DMSO 49.02% MEK (40:60 DMSO:MEK) | n/a | 706 ± 144 | 9 |
| 121024-TL-77-54-53b | 18% K2850-04 P(VDF-HFP) 0.15% LSNO 0.15% $BaTiO_3$ 32.68% DMSO 49.02% MEK (40:60 DMSO:MEK) | 0.92 | 673 ± 137 | 16 |

The data suggests that fiber diameter in the presence of both the LSNO and $BaTiO_3$ is similar or less than for the compositions with only $BaTiO_3$ as a high dielectric additive, but is much higher than for the composition with only high dielectric LSNO. In particular, substitution of the LSNO with the $BaTiO_3$ (sample 53) led to the fiber diameter increasing. The presence of the $BaTiO_3$ in the system with the LSNO in the same amount (sample 52) also resulted in the fiber size increasing. As such, no evident synergetic effect of two dry powder high dielectric additives was observed.

Experiment 11

Increasing the $BaTiO_3$ Content

A study to vary $BaTiO_3$ concentration was conducted to determine if an increased amount of the high dielectric material would decrease the fiber diameter and or increase the fiber output (Table 16 below). Prior to conducting the $BaTiO_3$ concentration study, it was decided that K705 PVDF powder was the desired option out of the PVDF and P(VDF-HFP) samples tested therefore the concentration study was carried out using K705 (see Table 11).

In general, the formulations were prepared by sonicating $BaTiO_3$ in DMSO for 1 h. With the increased amount of $BaTiO_3$, the DMSO/$BaTiO_3$ solution became thicker. With the belief that it would be difficult to transfer the $BaTiO_3$/DMSO solution, PVDF and MEK were added to the $BaTiO_3$/DMSO mixture. The mixture was stirred and heated in a water bath of ~60° C.

Despite the use of the water bath (as opposed to just placing the vial on the hotplate surface as had been done for previous formulation preparations), there were still solids stuck to the top sides of the jar rendering it impossible to obtain a uniformly mixed solution. Furthermore, despite using the same technique to prepare all three formulations, the solution with 3% $BaTiO_3$ seemed more difficult to mix well and to disperse the $BaTiO_3$ therein, as compared to the 1% and 4% $BaTiO_3$, which was unexpected.

Overall, it was difficult to mix the formulations, which rendered the concentration of the solution to be spun imprecise. Nevertheless, the solutions were spun in order to ascertain a general idea of the phenomenon which occurs with higher and higher amounts of $BaTiO_3$, even if the solutions were not exactly 1, 3 and 4% $BaTiO_3$.

TABLE 16

Effects of Increasing the $BaTiO_3$ Content

| Sample Code | Composition | Fiber Output (g/hr) | Fiber Diameter (nm) |
|---|---|---|---|
| 121017-JT-84-65-43 | 20% K705 0.29% BaTiO3 47.83% DMSO 31.88% MEK (60:40 DMSO/MEK) | 5.6 | 464 ± 347 |
| 121016-TL-77-47-47 | 20% K705 PVDF 1% $BaTiO_3$ 31.6% DMSO 47.4% MEK (40:60 DMSO/MEK) | 7.84 | 650 ± 403 |
| 121016-TL-77-49-49 | 20% K705 PVDF 3% $BaTiO_3$ 30.8% DMSO 462% MEK (40:60 DMSO/MEK) | N/A | 420 ± 213 |
| 121016-TL-77-50-50 | 20% K705 PVDF 4% $BaTiO_3$ 30.4% DMSO 45.6% MEK (40:60 DMSO/MEK) | 7.95 | 616 ± 409 |

The formulation with 1% $BaTiO_3$ (sample 47) spun fairly well. There was a good lay down and no major dripping. The fiber deposition seemed similar to the 0.3% $BaTiO_3$ (sample 43).

There was a little bit more dripping when the 3% $BaTiO_3$ formulation (sample 49) was spun. After the experiment, it was noted that the fiber looked bumpy and chunky and it was hypothesized that perhaps there were large agglomerates of $BaTiO_3$ still present as a result of the trouble mixing the solution. Furthermore, at the end of the spinning experiment it was observed that the tip of the nozzle was clogged and that the solution in the pipette and in the vial had started to precipitate or separate. Approximately 5-10 min after the spinning experiment the solution had formed a gel. Therefore it is possible that the chunky bumps were globs of separated PVDF.

On the other hand, the 4% $BaTiO_3$ formulation (sample 50) spun well and there was very little dripping.

SEM image analysis of these samples indicated that the 1% $BaTiO_3$ formulation was well dispersed whereas the 3% $BaTiO_3$ mixture had some agglomeration of particles and 4% $BaTiO_3$ was fairly well dispersed. It appears as though the difficulty in mixing the 3% $BaTiO_3$ sample did affect the dispersion of the $BaTiO_3$ particles.

On the other hand, in the samples with good dispersion of $BaTiO_3$ (e.g. 1% in sample 47 and 4% in sample 50), fiber diameter had increased by about 200 nm from the baseline 0.3% $BaTiO_3$ formulation.

The average fiber diameter for both the 3% $BaTiO_3$ remained essentially unchanged at 420 nm. It is possible that since the particles agglomerated, the potential enhanced effect was diminished and the material responded as a solution with little to no $BaTiO_3$ present. Overall, it appears that as the particles are better dispersed, the fiber diameter increases.

Upon examination of the fiber output results, concerns were raised regarding the reliability and accuracy of the fiber output data and the single nozzle experiment setup. The fiber output was high with 1% $BaTiO_3$, greater than the 0.3% $BaTiO_3$, but then dropped significantly for the 3% $BaTiO_3$ and then increased again back up for the 4% BaTiO3 formulation. These results did not follow the expected trend of increasing fiber output with increasing $BaTiO_3$ content, and suggest that there may have been experimental problems.

Based on the difficulty mixing the higher concentration $BaTiO_3$ mixture and the subsequent inconsistent results obtained, the 3% and 4% $BaTiO_3$ solutions were prepared and evaluated again.

A slightly different preparation method was used and the solutions were spun to determine if a better-mixed solution would produce more consistent results. This other approach involved adding the DMSO/$BaTiO_3$ mixture to a mixture of MEK/PVDF since in previous preparations of other formulations less material ended up adhering to the top sides of the jar.

The DMSO and $BaTiO_3$ solution was sonicated for 1 h while a mixture of the PVDF and MEK was stirred and heated on a hotplate set to 75° C. It was difficult to transfer the entire mixture since the thick solutions left a film of material on the sides of the vial. Upon transferring the $BaTiO_3$ solution to the PVDF mixture, some MEK would reflux in the capped jar which was heated to 75° C. During the reflux process, the MEK would carry some $BaTiO_3$ to the top sides of the jar and once deposited on the walls, the $BaTiO_3$ was difficult to remix into the solution. The high concentration $BaTiO_3$ mixtures remain difficult to prepare and unfortunately, the second preparation method did not improve the homogeneity nor improve the precision of the solution composition. Nevertheless, the samples were spun and the results are presented here:

TABLE 17

Comparison of 3% and 4% $BaTiO_3$ Content

| Sample Code | Composition | Fiber Output (g/hr) | Fiber Diameter (nm) |
|---|---|---|---|
| 121016-TL-77-49-49 | 20% K705 PVDF<br>3% $BaTiO_3$<br>30.8% DMSO<br>46.2% MEK<br>(40:60 DMSO/MEK) | N/A | 420 ± 213 |
| 121025-TL-77-56-49a | 20% K705 PVDF<br>3% $BaTiO_3$<br>30.8% DMSO<br>46.2% MEK<br>(40:60 DMSO/MEK) | N/A | N/A |
| 121025-TL-77-56-49b | 20% K705 PVDF<br>3% $BaTiO_3$<br>30.8% DMSO<br>46.2% MEK<br>(40:60 DMSO/MEK) | Fiber + paper weighed more than paper alone . . . | 396 ± 97 |
| 121016-TL-77-50-50 | 20% K705 PVDF<br>4% $BaTiO_3$<br>30.4% DMSO<br>45.6% MEK<br>(40:60 DMSO/MEK) | 7.95 | 616 ± 409 |
| 121025-TL-77-57-50 | 20% K705 PVDF<br>4% $BaTiO_3$<br>30.4% DMSO<br>45.6% MEK<br>(40:60 DMSO/MEK) | 1.74 | 401 ± 139 |

The fiber spinning observations for the repeated formulations were different than the first batch of samples. The second 3% $BaTiO_3$ solution (121025-TL-77-56-49a) dripped a lot more than the previous 3% $BaTiO_3$ sample (121016-TL-77-49-49). A section of PTFE tubing was inserted into the pipette tip to restrict the solution flow rate, which reduced the dripping resulting in dry fiber. Given that dry fiber was produced this time, a fiber output measurement was carried out. However, after waiting 24 h to weigh the fiber, the combined fiber and paper weighed less than the paper before the fiber was deposited on it, which is not possible and indicates again experimental error. Therefore, no fiber output result is reported.

The fiber spinning process for the 4% $BaTiO_3$ solution (121025-TL-77-57-50) was similar to the previously spun 4% $BaTiO_3$ solution (121016-TL-77-50-50), although, the fiber output was significantly lower (1.74 g/min) than the first sample (7.95 g/min).

SEM images of the 3% samples again showed mostly agglomerated particles. However, SEM images for the 4% samples were very different. In particular, the particles were well dispersed in the first 4% sample and were agglomerated in the second 4% sample.

Since the spinning process and fiber quality was not reproducible for the 3% $BaTiO_3$ solution and the fiber output and particle dispersion were not repeatable for the 4% $BaTiO_3$ mixture, this raises concerns about managing a system with a high concentration of $BaTiO_3$ particles and the overall general acceptability of all single nozzle results.

In order to evaluate the potential advantages and disadvantages of increased $BaTiO_3$ concentrations, it was determined that a dispersant should be used. The hope was that the dispersant would improve the dispersion and stability of the mixture, which would lead to more reproducible fiber results. Furthermore, the fiber output was considered not to be an accurate measurement to carry out without a controlled solution flow rate and a larger fiber sample mass, and therefore no further fiber output measurements were carried out on the single nozzle experiment setup. The fiber output data from the single nozzle was also not really necessary to determine whether a solution was appropriate to scale up and try on the disk spinning apparatus.

Experiment 12

Dispersion of $BaTiO_3$ Using a Dispersant

In the single nozzle experiments, the fiber diameter for the baseline formulation without $BaTiO_3$ (sample 22) was lower by about 200 nm in comparison to the formulation with $BaTiO_3$, (sample 18). However, the fiber output and quality improved with $BaTiO_3$ incorporated in the formulation, rendering sample 18 superior over sample 22. Hence, sample 18 was used as the new baseline formulation.

Preliminary experiments using a disk apparatus (i.e. the apparatus of FIG. 1) demonstrated that the presence of $BaTiO_3$ in the baseline formulation (sample 28) had little to no effect on the fiber diameter in comparison with the baseline formulation without $BaTiO_3$ (sample b).

For the disk setup, in contrast to the nozzle experiment setup, the fiber production rate is predominantly controlled by the applied air pressure used to adjust the flow of solution. The presence of the high dielectric particles under these conditions does not have the opportunity to change the fiber output as in the single nozzle experiments.

An experiment was therefore conducted to determine if an increased amount of $BaTiO_3$ was required in order to observe an effect such as reduced fiber diameter or any other form of improvement with the disk apparatus. The previous study examining an increased amount of $BaTiO_3$ did not show any evidence of decreasing fiber diameter. However, this may have been because there was insufficient dispersion of the $BaTiO_3$ particles. It is believed that in order to increase the effective dielectric constant of a material, the high dielectric particle additives must be well dispersed therein.

Possible dispersants that may be useful for dispersing $BaTiO_3$ include phosphonic acids, particularly those that are tailored to be more compatible with the host polymer (for example, a fluorous phosphonic acid could be especially suitable for dispersing $BaTiO_3$ nanoparticles in P(VDF-HFP)). Other dispersant options are Dupont Zonyl UR fluorophosphonic acid, but this and structurally similar alternatives are no longer available from Dupont.

Alternatively, other dispersants may include alkyltrimethoxysilanes. Both alkyl and perfluorinated alkyltrimethoxysilanes were available for this study. The nonafluorohexyltrimethoxysilane (F9TMS) was initially tried (see Table 18).

One approach for using a dispersant involves a pretreatment method where the $BaTiO_3$ particles were reacted with an excess of the dispersant, then isolated, washed and dried before dispersing them in P(VDF-HFP). However, a simpler approach was selected for this study to conduct a proof of principle experiment to determine if there was any indication of an improvement in the dispersion of $BaTiO_3$ within PVDF.

It was assumed that the entire surface of the $BaTiO_3$ particle was covered with hydroxyl groups and the corresponding amount of F9TMS required to react in a 1:1 ratio with the hydroxyl groups was calculated. Methyl ethyl ketone (MEK) was added to $BaTiO_3$ and the mixture was sonicated for 25 min to pre-disperse the particles in the solvent. The dispersant, F9TMS was then dissolved in MEK and then added to the $BaTiO_3$ solution. The combined mixture was then heated and stirred at 80° C. for 1 h. The P(VDF-HFP) and DMSO were then added and stirred, and heated at 80° C. for 20 min until all P(VDF-HFP) was dissolved.

Two different concentrations of $BaTiO_3$ were examined, 1% and 4% $BaTiO_3$. Some unusual observations were noted during the nozzle spinning experiment, which suggested that the F9TMS was having at least some sort of effect on the spinning process. These observations included poor fiber lay down and lots of standup fiber. A slightly better lay down of fiber was possible only if craft paper alone was used as a substrate for fiber deposition (as opposed to mylar with craft paper on top). SEM images of the resulting fibers showed inconsistent results. In the 1% $BaTiO_3$ formulation (sample 59), the F9TMS seems to have caused the particles to agglomerate, and as such the $BaTiO_3$ particles were better dispersed without any dispersant added.

On the other hand, the SEM images of the 4% formulation with F9TMS (sample 61), demonstrated that the particles were much better dispersed if compared to 121025-TL-77-57-50, but about the same as 121016-TL-77-50-50. In comparing the 4% BaTiO3 solution which was poorly dispersed and 401 nm average diameter fiber without the dispersant (1210-25-TL-77-57-50), to well dispersed and 814 nm average fiber diameter with F9TMS (61), the data follows the dispersion/fiber diameter trend.

TABLE 18

Results of Dispersant Investigation

| Sample Code | Composition | Fiber Output (g/hr) | Viscosity (cP) | Fiber Diameter (nm) |
|---|---|---|---|---|
| 121109-JT-84-87-59b | 20% K705 PVDF<br>1% $BaTiO_3$<br>31.587% DMSO<br>47.381% MEK<br>0.032% F9TMS | N/A | 88.4 | 722 ± 229 |
| 121016-TL-77-47-47 | 20% K705 PVDF<br>1% $BaTiO_3$<br>31.6% DMSO<br>47.4% MEK<br>(40:60 DMSO/MEK) | 7.84 | N/A | 650 ± 403 |
| 121112-JT-84-91-61a | 20% K705 PVDF<br>4% $BaTiO_3$<br>30.35% DMSO<br>45.52% MEK<br>0.13% F9TMS | N/A | 98.18 | 814 ± 188 |
| 121016-TL-77-50-50 | 20% K705 PVDF<br>4% $BaTiO_3$<br>30.4% DMSO<br>45.6% MEK<br>(40:60 DMSO/MEK) | 7.95 | N/A | 616 ± 409 |
| 121025-TL-77-57-50 | 20% K705 PVDF<br>4% $BaTiO_3$<br>30.4% DMSO<br>45.6% MEK<br>(40:60 DMSO/MEK) | 1.74 | N/A | 401 ± 139 |

Experiment 13

Incorporating a Liquid High Dielectric Constant Additive

Propylene carbonate (PC) was selected to determine if a high dielectric liquid would be beneficial (perhaps more beneficial than solid super high dielectric nanoparticles) for producing small nanofibers at a high rate.

Propylene carbonate has a dielectric constant (∈) of 66, which is higher than DMSO, which previously was the highest dielectric constant (∈=47) solvent in the formulation.

PVDF K705 was selected as the starting polymer. Three different types of solutions based on the baseline formulation (sample 43) were then prepared, one where DMSO is completely replaced by PC (sample 62), a second one where the DMSO is halved and an equivalent of PC is added (sample 63), and finally a third mixture with both DMSO and PC, but no $BaTiO_3$ (sample 64) (Table 3.9.1).

The standard procedure for preparing the baseline formulation was employed and the PC was initially added to the DMSO/$BaTiO_3$ solution before sonicating. In the case where there was no DMSO in the formulation, the $BaTiO_3$ was sonicated in PC.

For sample 62 with no DMSO, it took considerably longer to dissolve the PVDF. The solution had to stir in a 70° C. oil bath overnight to dissolve the PVDF. It was also observed that the solution only remained homogenous when heated, and the solution precipitated as it cooled to room temperature and formed a gel. Therefore, it was not possible to perform viscosity and conductivity measurements or a spinning experiment with this sample.

The mixture with DMSO and PC (sample 63) dissolved more quickly (1 h25 min) than sample 62, although the baseline formulation can dissolve in <1 h, therefore PC does seem to be hindering the dissolution of the PVDF.

Sample 63 remained in the liquid state long enough to carry out the viscosity measurement (at 60° C.), and the spinning experiment (at room temperature), but then started to crystallize while preparing for a conductivity measurement.

The solution without $BaTiO_3$ (sample 64), was prepared by adding all the components together and then heating and stirring in the 70° C. oil bath. The PVDF dissolved readily and the mixture was well mixed and completely dissolved in <40 min. The solution remained in the liquid state for the viscosity and the spinning experiment but then turned cloudy and started to gel, therefore no conductivity measurement was performed.

For those samples that were spinnable the fiber diameter was comparable to the K705 baseline formulation in the 400 nm range. The PC does not seem to have a positive impact on the K705 formulation, but the potential for any constructive contribution to fiber production is hindered by the tendency of K705 to precipitate. The initial study with K705 provided some insight on incorporating PC into the formulation. However, it was evident that the PVDF crystallized easily making the solution difficult to handle at room temperature, which may be undesirable.

For the next set of experiments, the copolymer P(VDF-HFP) K2850-04, was used instead because it was known to be more soluble and less likely to crystallize at room temperature. Comparable formulations with K2850-04 with only PC and MEK (40:60) (sample 66) and PC/DMSO/MEK (20:20:60) (sample 65) were prepared using the same procedure followed for the K705 formulations.

The K2850-04 was definitely more easily dissolved in the presence of PC and MEK (sample 66) given that the mixture was well mixed and all dissolved in 2 h, in comparison to the corresponding K705 formulation which had to be stirred and heated overnight. However, this formulation did gel during the fiber spinning experiment. Sample 65 dissolved in 1.5 h and was the first mixture containing PC to remain liquid for the viscosity measurement, spinning experiment and the conductivity measurement.

TABLE 19

Results of Incorporating Propylene Carbonate (PC)

| Sample Code | Composition | Viscosity (cP) | Conductivity (μS/cm) | Fiber Diameter (nm) |
|---|---|---|---|---|
| 121017-JT-84-65-43 | 20% K705<br>0.29% BaTiO3<br>47.83% DMSO<br>31.88% MEK<br>(60:40 DMSO/MEK) | N/A<br>(48.44 cP for 40:60 DMSO/MEK solution scaled up for double disk) | N/A | 464 ± 347 |
| 121119-JT-84-93-62 | 20% K705 PVDF<br>0.3% $BaTiO_3$<br>31.88% PC<br>47.82% MEK<br>(40:60 PC/MEK) | 91.34 | N/A | N/A |
| 121119-JT-84-95-63 | 20% K705 PVDF<br>0.3% $BaTiO_3$<br>15.94% PC<br>15.94% DMSO<br>47.82% MEK<br>(20:20:60 PC/DMSO/MEK) | 86.69 | Solution began to precipitate/gel therefore could not obtain a stable reading | 470 ± 160 |
| 121119-JT-84-97-64 | 20% K705 PVDF<br>16% PC<br>16% DMSO<br>48% MEK<br>(20:20:60 PC/DMSO/MEK) | 76.29 | Solution went cloudy and then started to gel therefore could not obtain a stable reading | 381 ± 228 |

TABLE 19-continued

Results of Incorporating Propylene Carbonate (PC)

| Sample Code | Composition | Viscosity (cP) | Conductivity (μS/cm) | Fiber Diameter (nm) |
|---|---|---|---|---|
| 120816-TL-77-30-28 | 18.13% K2850-04 P(VDF-HFP)<br>0.29% $BaTiO_3$<br>32.63% DMSO<br>48.95% MEK<br>(40:60 DMSO/MEK) | N/A | N/A | 720 ± 256 |
| 121119-JT-84-100-66 | 18% K2850-04 P(VDF-HFP)<br>0.3% $BaTiO_3$<br>32.68% PC<br>49.02% MEK<br>(40:60 PC/MEK) | 71.74 | N/A | N/A |
| 121119-JT-84-99-65b | 18% K2850-04 P(VDF-HFP)<br>0.3% $BaTiO_3$<br>16.34% PC<br>16.34% DMSO<br>49.02% MEK<br>(20:20:60 PC/DMSO/MEK) | 65.68 | 11.6 | 145 ± 48 |
| 121119-JT-84-102-67 | 18% K2850-04 P(VDF-HFP)<br>0.3% $BaTiO_3$<br>8.17% PC<br>32.68% DMSO<br>40.85% MEK<br>(10:40:50 PC/DMSO/MEK) | 78.19 | 13.05 | 363 ± 132 |

The viscosity for sample 65 was 65.68 cP, which is approximately the same as the baseline solution without PC (sample 28). Therefore, incorporating PC into the formulation at a ratio of 20:20:60 PC/DMSO/MEK does not seem to have a significant effect on the solution viscosity.

However, despite the similar solution viscosity, the fiber diameter is considerably lower for sample 65, suggesting that PC does have a positive effect on fiber diameter. The fiber diameter dropped from 720 nm to 145 nm for sample 65.

The conductivity measurement indicated a solution conductivity of 11.6 μS/cm for sample 65, which was only slightly higher than the baseline formulation (9.8 μS/cm) suggesting that PC does not have a significant effect on the solution conductivity.

In the $BaTiO_3$ concentration studies, it was hypothesized that the viscosity might play a more dominant role in dictating the fiber diameter than high dielectric $BaTiO_3$ particles, even with higher concentrations of $BaTiO_3$. The PC study seems to display a different outcome. The viscosity of the PC formulation (sample 65) was comparable to the baseline formulation (sample 28) yet the fiber diameter was drastically lower, which may suggest that the higher dielectric constant of PC, a liquid high dielectric additive, is capable of having a more noteworthy impact on reducing fiber diameter than a high dielectric solid particle.

In other words, if PC is present, then an ultra-low viscosity may not be required to obtain an ultra-low fiber diameter. Furthermore, PC may be more beneficial over $BaTiO_3$ since it does not increase the viscosity and therefore reduces the amount of obstacles to produce small nanofiber.

One more formulation containing PC was prepared to determine if the amount of PC could be reduced in order to improve the solubility of K2850-04 further and still have enough PC present to reduce fiber diameter.

The solvent ratio was adjusted to 10:40:50 PC/DMSO/MEK in sample 67. The intent was to maintain the DMSO content the same as the baseline, add a small amount of PC and adjust the MEK accordingly. Previous studies indicated that an MEK concentration of 40-60% all displayed similar results, therefore a slight adjustment to the MEK content was considered sufficient to accommodate PC in the formulation.

Sample 67 was scaled up from the standard 50 g used to prepare other PC formulations to 60 g and as a result, the vial used to sonicate the $BaTiO_3$ solution was not of sufficient volume to contain both DMSO and PC as was previously carried out. Therefore the PC was added to the MEK/P(VDF-HFP) mixture instead.

Surprisingly, the combination of PC and MEK seemed to dissolve the P(VDF-HFP) faster than just MEK alone. The P(VDF-HFP) dissolved in just PC and MEK while stirring in the 70° C. oil bath in only 45 min. This was unusual because normally, after stirring MEK/P(VDF-HFP) at 70° C. for 45 min, polymer pellets still remain. It was convenient that PC assisted in dissolving P(VDF-HFP) faster, but it was surprising considering in previous P(VDF-HFP) experiments when the DMSO/PC/$BaTiO_3$ solution was added to the MEK/P(VDF-HFP) mixture, it took longer to dissolve than when preparing the baseline mixture (sample 28).

In addition, PC seemed to cause the P(VDF-HFP) to crystallize and gel in sample 66. Sample 67 is thus a good example of how the order of addition of solution components can affect sample preparation. Moreover, sample 67 was stable at room temperature and the viscosity, conductivity and fiber data were collected.

The viscosity of the sample 67 was slightly higher (78.19 cP) than the baseline formulation, which likely explains why there was no spray or dripping during the spinning experiment. This formulation may be slightly more viscous considering there is less MEK present since MEK is the least viscous solvent in the mixture. Perhaps the increased viscosity produced somewhat larger fibers. Sample 67 further supports the theory that the PC plays a role in reducing the fiber diameter and it appears that as the PC concentration decreases, less of a positive effect is observed.

Sample 65 produced the smallest diameter fibers out of all of the solutions studied using the single nozzle spinning experiment setup. The next best formulation was the LSNO sample 44 which produced fiber with an average diameter of 312 nm. The LSNO nanoparticles have an ultra-high dielectric constant (∈~100,000), greater than $BaTiO_3$ (∈~1,700), which may explain why the fiber diameter was less for LSNO than for the baseline formulation.

Propylene carbonate (PC) displayed a very significant decrease in fiber diameter. However, 16.34 overall weight percent of PC was required to achieve this effect, whereas only 0.3% LSNO was required to decrease the fiber diameter.

It is possible that a greater concentration of LSNO may reduce the fiber diameter down to 145 nm or less, although a greater concentration of LSNO may also increase the solution viscosity resulting in a larger fiber diameter. LSNO nanoparticles are also quite expensive, thus PC may be more practical alternative even if 16% is required. In conclusion, a liquid high dielectric agent may be more effective than a nano-size solid high dielectric agent, simply because it will disperse more effectively. Extremely high dielectric properties cannot be used to produce small fibers at high rates if the small particles are not dispersed properly. Hence, a liquid with a high, but not exceedingly high dielectric constant, can outperform a particulate agent of enormously high dielectric agent in the right circumstances.

Discussion of Material Qualification Investigations

In general, the material qualification investigations focused on the following constituents:

Polymer and active solvent;

Low vapor pressure latent solvent with highest possible dielectric constant for smallest fiber size and highest volume of production while suppressing premature evaporation during fiber formation;

Additives with varying magnitudes of dielectric constant for promoting fiber attenuation via a dielectrophoretic force;

A surfactant to aid dispersion of dielectric additives, reduce surface tension, and/or modify the polymer-solvent interaction; and Conductive additives to increase the conductivity of the solution;

As opposed to conventional electrospinning, which utilizes Coulomb and electric forces to drive fiber attenuation, the motivation here was to design materials incorporating dielectric additives to drive fiber attenuation via dielectrophoretic forces. Two distinct classifications of material architectures that incorporate dielectric additives can be considered.

The first is a "D2-additive package", which includes material, generally a solid nanoparticle (<50 nm), having very high dielectric constant, such as $BaTiO_3$ (∈>1000) or LSNO nanoparticles (∈>100,000).

The second is a "D1-additive package", which includes a material, generally liquid, having a moderately high dielectric constant such as PC (∈~60).

In some embodiments, D1 and D2 additive packages may be combined (e.g., moderate dielectric liquid stacked with a high dielectric nanoparticle) so as to provide improved performance (i.e. smaller particle sizes).

In general, the various solvents and dielectric additives may be selected in such a manner as to create a "dielectric ladder", where each additional additive has a higher dielectric constant that the preceding additive. For instance, the components of the following mixture are listed in the order of increasing dielectric constant: [P(VDF-HFP)/MEK/DMSO/PC/$BaTiO_3$].

For the scope of this study, material architectures using a D2-additive package primarily focused on using polarizable ceramic nanoparticles (such as $BaTiO_3$) in a material arrangement such as [P(VDF-HFP)/MEK/DMSO/$BaTiO_3$], referred to as the baseline $BaTiO_3$ mixture. The most significant insights appear to be the following:

As more $BaTiO_3$ is added, the solutions viscosity increases.

Well dispersed $BaTiO_3$ results in decreased fiber diameter.

Experiments conducted with higher concentrations of $BaTiO_3$ were generally not repeatable as dispersion of these particles becomes progressively more difficult.

Solution viscosity is one of the governing properties that strongly dictates fiber diameter. One can consider the simple kinetics argument that at high viscosity, the attenuation of the fiber becomes slower and in the short timeframe of the process, the smallest theoretically possible fiber size cannot actually be attained. Hence, even a very good dielectric mixture simply cannot get fiber size small enough at the required speed before the fiber has ejected the solvent and become a solid if the viscosity of the mixture is high.

For subsequent studies, a D1-additive package was incorporated with the $BaTiO_3$ baseline mixture (i.e., D2-additive package), resulting in mixtures of the form [P(VDF-HFP)/MEK/DMSO/PC/$BaTiO_3$], referred to as the Propylene Carbonate (PC) baseline mixture. The findings from studies using the PC baseline mixture are as follows:

In the presence of PC (a liquid, higher dielectric constant additive) the viscosity of the solution [P(VDF-HFP)/MEK/DMSO/PC] remained constant, but the fiber diameter decreased by 5×(720 nm to 145 nm).

A high dielectric constant solvent D1-additive package (e.g., PC) produces a homogeneous solution, which may be more advantageous for promoting fiber attenuation than using a higher-dielectric nanoparticle D2-additive package (e.g., $BaTiO_3$), which produces a heterogeneous solution.

Material studies so far show that solutions with $BaTiO_3$ may have a limited to negligible effect on fiber attenuation. On the other hand, solutions with a higher dielectric LNSO nanoparticle [P(VDF-HFP)/DMSO/MEK/LSNO], referred to as the baseline LSNO mixture, were able to reduce the fiber diameter, but only by 2.5×. It is believed that this is entirely the result of the dispersion of these materials and not as a result of their relative dielectric properties.

In addition, studies were conducted with different types of PVDF polymer, namely PVDF in the form of a co-polymer P(VDF-HFP) (e.g., K2850-04) and homopolymer PVDF (K705). From these studies, it was observed that:

PVDF in the form of the homopolymer (e.g., PVDF K705) may be more useful for producing fibers of the smallest diameter due to the lower viscosity of the solutions in comparison with the co-polymer. Considering the chemical structure of the homo- and co-polymers of PVDF, the difference in the fiber size might be attributed to the branching of the polymer chain. In certain cases, when the solubility of the formulation components is an issue, the P(VDF-HFP) co-polymer may be more beneficial.

Mass Production Optimization Experiments

Mass production optimization experiments were conducted using an apparatus similar to the apparatus 10 as described above and as shown in FIG. 1. In general, a polymer solution was deposited into a reservoir (i.e. a syringe) coupled to the feed chamber or dispenser 16.

Under the application of applied air pressure (solution pressure, Δp), the polymer solution is pumped through PTFE tubing from the reservoir to the fiber spinning apparatus.

A production rate Q was obtained by measuring the volume of polymer solution that passes from the reservoir within a given interval of time. Fiber production is the polymer solids content of the mixture (as a fractional weight) times this value of Q.

As generally described above with respect to FIGS. 1 and 2, the polymer solution is deposited at (or near) the axis of rotation of the disk surface 14 that is rotating with a speed w. The mixture then flowed outwardly under the influence of centripetal forces, eventually separating from the edge of the disk to form particles.

In the presence of the electrostatic field gradient existing near the surface of the disk and surrounding the individual prefibers emerging from the edge of the disk, the particles tend to further attenuate. Any residual solvent is ejected and/or evaporates during this process, and the remaining polymer particles (fibers) are deposited on the collector plate if one is arranged to be nearby.

Two methods for collecting particles are discussed herein: (i) stationary collection and (ii) continuous collection. During stationary collection, a substrate remained stationary on top of the collector plate and fibers accumulate thereon. On the other hand, for experiments conducted with continuous collection, the substrate was transported in a continuous manner and allowed to slide along the surface of the collector plate (which is usually some form of metal grid, mesh, foil, sheet, plate).

Starting from a location directly underneath the central axis of the apparatus' spinning rotor (r=0), the particle size generally varies in the radial direction from the inner-diameter (ID), middle (M), to the outer-diameter (OD) sampling locations. Regardless of the collection method (e.g., stationary vs. continuous), the spatial location of ID, M, and OD is similar, thus permitting direct comparison of estimated particle sizes. In general, particle size measurements were taken from the top surface of the fiber mat that formed on the substrate and were imaged via scanning electron microscopy (SEM).

An estimate of the strength of the electrostatic field was indirectly determined by the voltage-distance quotient, where the distance is based on DCD (disk-to-collector distance). It should be noted that all experiments were conducted using a "hot-head" configuration, where high-voltage (HV) was applied to the disk of the spinning apparatus and the collector plate was grounded. Positive voltage was applied to the spinning apparatus, generating a positive electrostatic field with field lines directed from the spinning apparatus to the collector plate. In other embodiments, other configurations for the apparatus may be possible, such as a "cold-head" configuration wherein the apparatus is grounded and the collector plate is charged.

It should again be noted that one of the salient features of dielectrophoretic spinning is the dependence of this phenomenon on the electric field gradient squared and not on the electric field strength as in conventional electrospinning. The grounded collector plate or counter-electrode can be entirely eliminated and the production of fibers or particles will continue. In these cases, dielectrophoretically-spun fibers will eject into the surrounding air and can be collected onto a nearby collecting surface using vacuum. This would basically be similar to the methods used to collect spun-bonded and melt-blown fibers.

Heat was supplied via hot air to a cowling that surrounds the spinning disk. Two high-temperature plastic supply lines were used to carry the heated air into the apparatus. The volume of air required is modest as its only function is to keep the machine and the surrounding surfaces at a target temperature.

In some of the experiments described herein, the polymer solution, disk, and ambient air are heated to explore the effect of heat on the production of particles. Operating at elevated temperature influences several key parameters, such as: (i) viscosity, (ii) solvent vapour pressure/evaporation, iii) solvent-polymer interactions and compatibility, iv) the dielectric constant of the various ingredients, especially high dielectric ceramic particles, v) the distance the particle or fiber can attenuate before the polymer "freezes" and becomes a solid.

It is believed that the viscosity of the polymer mixture and vapour pressure of solvents can be controlled or manipulated in such a manner as to encourage attenuation and form smaller particles prior to solidification of the polymer.

In addition, at elevated temperatures, the polymer will disperse into solvents that are normally highly incompatible with the polymer, which allows the use of solvents with much higher dielectric constants. Even polymers of low dielectric constant can be dealt with successfully at elevated temperatures. They can be dispersed in relatively high dielectric solvents directly. The combination of heat and the presence of surfactants and dispersants is synergistic and can allow enormous flexibility in formulating mixtures for spinning for virtually all polymers.

In some cases, the hot air injected into the cowling not only heats the spinning disk but also distributes hot air uniformly around the disk and emerges from the cowling at a velocity, Uo. This heated air helps to control the ambient temperature, To, in the zone where attenuation occurs. This heated air helps to eliminate the local ambient air temperature as a variable. For the range of velocities, Uo from 2.5 m/s to 8.0 m/s, it was found that, on the average, the fiber diameter decreases with an increase in velocity.

Prior to initiating each experiment, a bulk quantity of polymer solution is heated and mixed on a heated magnetic stir plate at a solution temperature Tsoln of approximately 100° C. The pre-heated solution was then transferred to the reservoir, and dielectrophoretic spinning commenced immediately thereafter. This pre-heating was found to greatly reduce fiber size and improve production rates under almost all conditions.

The results of these optimization experiments are discussed generally below.

Effect of System Heat and Cowling Velocity

"System Heat" is defined as a combination of pre-heating the polymer solution, applying active heat to components of the spinning apparatus (i.e., drive shaft and disk pack), and ensuring that the fibers enter a heated zone surrounding the cowling. It was observed that the addition of System Heat greatly increases both fiber production rate and reduces average fiber diameter.

Effect of Rotational Speed

The rotational speed of the fiber spinning apparatus was explored for a range of speeds from approximately 1700 rpm to 3400 rpm on a 6" diameter disk. Generally, the fiber diameter decreases with an increase in speed, which is believed to be the result of smaller pre-fibrils generated at the disk edge under the influence of greater centripetal force on the polymer film in the disk pack. However, the change in fiber size is only gradual and modest and does not encourage the use of extraordinarily high speeds to drive fiber size downward or production rates upward. Mechanical simplicity of low-speed spinning disks is highly desirable to provide safe and reliable (i.e., long-running) equipment.

Effect of Fiber Deposition Thickness

How the thickness of a fiber web impacted quality (laydown texture, dryness, and fiber size) was explored by either forming a thick fiber deposit on a stationary substrate or forming very thin layers by casting fibers onto a moving substrate.

It was observed that the fiber laydown texture and dryness improve as the deposition thickness decreases. The fiber laydown texture is more uniform for thin deposits since there is less surface charge in the fiber, thereby suppressing fiber standup. In addition, uniformity of the web was very good for thin deposits as the fibers appear to search out areas of low deposition and thereby naturally create a highly uniform layer.

The dryness of thin webs is superior since ejected and/or evaporated solvent does not perpetually precipitate on the static sample of collected fiber. It was also observed that the fiber size did not vary or become less uniform with varying thickness of fiber deposition.

Effect of Temperature and Production Rate

The effect of temperature and production rate on fiber quality was explored for three mixtures referred to as the $BaTiO_3$, LSNO, and PC baseline mixtures. It was observed that fiber diameter is generally constant over a wide range of temperature and production rate. Eventually, at exceedingly high rates of production, average fiber size increases. Elevated temperatures support the production of smaller fibers, at higher volume, and tend to result in fiber webs with improved strength.

It is suspected that the fiber diameter may remain constant over a wide range of production rates whenever the fibers can closely approach their limit to attenuation (where attenuation forces are eventually counter-balanced against surface tension). This should be possible whenever the viscosity of the mixture is low, which allows very rapid attenuation, and the time available to attenuate is extended by the use of solvents that are ejected or evaporate slowly.

However, a marked increase in production rate may increase fiber diameter because pre-fibril size eventually grows and so the amount of attenuation required eventually exceeds the capabilities of the system. Exceedingly high production rates in small poorly ventilated areas can also result in wet fiber because the solvent is ejected or evaporated, but is present in such huge quantities that it interferes with the formation of dry fiber (literally it is being filtered from the air by the fibers and being drawn to the collector).

To enhance dry fiber formation, a small flow of air, moving counter-current to the direction of fiber collection (i.e. the fibers are drawn down by electrostatic attraction to the collector electrode, while the counter-current air carries the solvent particles and vapor upward) can be used. When this counter-current air is gently heated, the web is of superior quality, uniformity, and strength.

In some cases, the LSNO baseline mixture exhibits dry fiber formation around the disk edge, referred to as bearding, and small nodes of dry fiber are found embedded in the fiber mat, referred to as tufts. As the temperature is increased for a given production rate, the fiber size in this case actually increases, which is contrary to that observed with other mixtures.

It is suspected this behavior occurs because an absolute attenuation limit is not being achieved. It is believed that the solvent flashes off so readily that the viscosity rises and attenuation terminates prematurely.

Because the solvent is not highly volatile, it is believed that the solvent is being prematurely ejected when this super-high dielectric additive is used.

This condition becomes worse with elevated temperature. To a degree, the dielectrophoretic forces are now so great that the solvent is being ejected before full attenuation is achieved. In fact, solvent is being ejected before the fluid can separate from the disk.

For LSNO, when the production rate is increased at a given temperature, the fiber diameter is actually reduced, which is also contrary to the behavior encountered with other mixtures. It is speculated that a reduction in fiber diameter with increasing flow is because the amount of solvent accumulating within the surrounding production environment is actually excessive. This actually benefits this unique system. Specifically, there is so much solvent that the fiber loses net solvent more slowly and can attenuate further before viscosity rises and causes a cessation of attenuation.

The effect of decreasing fiber diameter with an increase in production rate can, in fact, be observed for other mixtures, which also exhibit fiber imperfections such as bearding and tufts. Thus, these findings suggest that the excessive ejection/evaporation regime is not unique to the LSNO baseline mixture, and that other mixtures also exhibit behavior in accordance with this regime. It is rather pleasant to obtain a better product, with smaller fibers, as production rates increase, so the formation of bearding is actually a sign that production flow should be increased.

The difference between the LSNO and $BaTiO_3$ baseline mixtures is the choice of nanoparticle. However, bearding and tuft formation are restricted to the LSNO baseline mixture. It is suspected that, since the dielectric constant of LSNO ($\in$~100,000) is markedly greater than $BaTiO_3$ ($\in$~1,750), the LSNO baseline mixture experiences greater dielectric ejection and evaporation, thereby promoting more rapid solvent loss than the $BaTiO_3$ baseline mixture.

ADDITIONAL DISCUSSION

Table 20 and Table 21 below list some exemplary results that were shown to have desirable performance in generating small particles:

TABLE 20

Summary of Results

| Test | | Solution conductivity | Solution viscosity | Solution pressure (psi)/ Production rate | Population of nanofibers with diameters <350 nm, % | | |
|---|---|---|---|---|---|---|---|
| Case | Composition | (μS/cm) | (cP) | (mL/min) | ID | M | OD |
| 5a | 18% P(VDF-HFP) (K2850-04) 82% DMSO | n/a | 200 | 3/11 | n/a | n/a | n/a |
| | | | | 4/16 | n/a | n/a | n/a |

TABLE 20-continued

Summary of Results

| Test Case | Composition | Solution conductivity (μS/cm) | Solution viscosity (cP) | Solution pressure (psi)/ Production rate (mL/min) | Population of nanofibers with diameters <350 nm, % ID | M | OD |
|---|---|---|---|---|---|---|---|
| 5b | 18% P(VDF-HFP) (K2850-04) 32.8% DMSO 49.2% MEK (40/60 DMSO/MEK) | 8.1 | 60 | 3/32<br>4/39 | 99<br>82 | 78<br>57 | 60<br>54 |
| 5c | 18% P(VDF-HFP) (K2850-04) 0.3% BaTiO3 32.63% DMSO 48.95% MEK (40/60 DMSO/MEK) | 9.79 | 72 | 3/29[CC]<br>4/36[CC] | 84<br>74 | 80<br>85 | 77<br>59 |
| 5d | 18% P(VDF-HFP) 0.3% LSNO 32.63% DMSO 48.95% MEK (40/60 DMSO/MEK) | 9.1 | 82 | 3/30[CC]<br>4/40[CC] | 72<br>89 | 68<br>85 | 58<br>70 |
| 5e | 20% PVDF (K705) 0.3% BaTiO3 31.88% DMSO 47.82% MEK (40/60 DMSO/MEK) | n/a | 48 | 3/28[TDG]<br>4/44[TDG] | 73<br>85 | 69<br>46 | 44<br>37 |

TABLE 21

Summary of Various Results (continued)

| Test Case | composition | solution conductivity (μS/cm) | solution viscosity (cP) | Solution pressure (psi)/ Production rate (mL/min) | Population of nanofibers with diameters <350 nm, % ID | M | OD |
|---|---|---|---|---|---|---|---|
| 5f | 23% PVDF (K705) 0.3% BaTiO3 30.68% DMSO 46.02% MEK (40/60 DMSO/MEK) | 25.05 | 118 | 3/17<br>4/21 | 63<br>64 | 68<br>63 | 34<br>55 |
| 5g | 18% P(VDF-HFP) (K2850-04) 0.3% BaTiO3 32.68% DMSO 49.02% BuAc (40/60 DMSO/BuAc) | 3.34 | 94 | 3/18<br>4/25 | 85<br>88 | 71<br>55 | 50<br>54 |
| 5h | 18% P(VDF-HFP) (K2850-04) 0.3% BaTiO3 32.68% DMSO 49.02% IPrAc (40/60 DMSO/IPrAc) | 3.45 | 91 | 3/19<br>4/27 | 86<br>92 | 72<br>85 | 35<br>46 |
| 5i | 18% P(VDF-HFP) (K2850-04) 0.3% BaTiO3 16.34% DMSO 16.34% PC 49.02% MEK (20/20/60 DMSO/PC/MEK) | 11.6 | 66 | 3/25@170 (Celsius)<br>4/33@170 (Celsius) | 100<br>98 | 100<br>92 | 89<br>83 |
| 5j | 18% P(VDF-HFP) (K2850-04) 2% DTMAB 32% DMSO 48% MEK (40/60 DMSO/MEK) | 1038 | 63 | 3/23[CC]<br>4/38[CC] | 88<br>89 | 94<br>76 | 87<br>62 |

In particular, the compositions listed in Table 20 and Table 21 have produced small nanofibers (<350 nm) with great uniformity. The major differences of these solution mixtures as compared to the other solution mixtures include:

If possible, they start with a polymer such as PVDF with an elevated dielectric constant, such as a dielectric constant greater than 5.

They use a solvent or solvent blend whose ingredients already have a relatively high dielectric constant (greater than 15) and in some cases greater than 30;

They include a modest amount of a liquid (usually less than 10%) with even higher dielectric constant such as PC ($\in$~60, D1-additive package); and They have a material with very high dielectric constant such as $BaTiO_3$ or LSNO ($\in$>1000, D2-Additive package) present in quite small amounts (generally less than 4-5% and usually less than 1%);

They include an additive such as DTAB ($\sigma$~1038 μS/cm at 2% of DTAB) to help disperse the ingredients and lower surface tension.

Hybrid Systems

It has also been discovered that, in some cases, dielectrophoretic spinning may be able to generate small particles (fibers) at relatively large production rates when a mixture includes a relatively small amount of a suitable solvent (i.e. 10-75% solvent) into which a polymer has been dispersed (i.e. 25-90% by weight polymer in the mixture).

These systems may generally be referred to herein as "Hybrid" systems. They are a hybrid because they are not strictly a solvent dispersion and they are not strictly a molten polymer, but they are generally a dispersion of a hot or even molten polymer where the heating is sufficient to have nearly or completely overcome the polymers cohesive forces and the polymer itself is now softened or fluid at the elevated temperature of these systems.

In the Hybrid case, a polymer is dispersed in a relatively small volume of solvent (as compared with previously solvent-polymer mixtures that often include 80% or more of solvent). Such hybrid systems make it possible to spin nanofibers from low melt index polymers, but using equipment usually reserved for spinning polymer melts of extremely high melt flow. For example, these Hybrid systems can be directly spun using ordinary melt blowing and melt spray equipment routinely used to produce large fibers.

These Hybrid systems can include D1 and D2 additives, surfactants and dispersants, and the other elements of the mixtures outlined above. However, the difference is that the mixture will be heated so strongly that solvents and other ingredients that would normally not form a suitable dispersion at room temperature (or a moderate temperature) become effective at these much higher temperatures.

For instance, Hybrid compositions may be subjected to modest heating (i.e. at temperatures approaching the softening temperature of the polymer) to temperatures above the melting temperature of the polymer and beyond.

As the temperature of the mixture increases to this degree, the dispersion forces of the polymer within a given solvent greatly increase and the cohesive forces between the polymer molecules eventually collapse (i.e., the polymer melts).

Heating greatly increases the entropy of the system so that a polymer will disperse even into a solvent that is poorly matched by its Hansen Solubility Parameters. These parameters describe the dispersion, polar, and hydrogen bonding elements of the solvent and the polymer. Normally, a polymer will dissolve only in a solvent that closely matches its own Hansen Solubility Parameters. However, solvent and polymer compatibility expand as temperature increases and this expansion become potentially very large as one approaches and exceeds the polymer's melting point.

At elevated temperatures approaching or exceeding the melting point of the polymer, the solvent changes from a "solvent" to a material acting more as a "diluent" where the solvent molecules are now intercalated between mobile polymer molecules. When the heated polymer is mixed with a solvent that is poorly matched in Hansen Solubility Parameters, the polymer tends to remain as a tightly coiled structure (i.e., a polymer-rich micelle) floating within a thin sea of smaller solvent molecules.

This condition results in very low viscosity mixtures even when the polymer's molecular weight is high and the polymer's melt index is quite low. This condition also produces exceedingly good dielectric contrast between the low dielectric polymer micelle and the surrounding high dielectric solvent and additive package. It is this micelle structure and the enormous differences in dielectric constant of the two materials that creates a large dielectrophoretic force when such a mixture is placed in a high electric field gradient.

Such high dielectric contrast requires that a polymer with a relatively low dielectric constant (which usually cannot be dispersed within a high dielectric solvent and additive mixture), is forced to form a stable dispersion with these materials. This allows the formulation of very powerful dielectric mixtures and the use of very small amounts of solvent to achieve a very low viscosity.

The presence of such a small amount of solvent may also make the process much more environmentally attractive, reduce costs, increase dry fiber net production, and allows the use of very simple equipment such as ordinary melt spray and melt-blown fiber systems.

Hybrid systems generally demand progressively smaller amounts of solvent as polymer molecular weight decreases. That is, while a very high molecular weight polymer grade could require 50-60% of solvent by weight to achieve a low-viscosity mixture that is easily converted to fibers, this drops to as little as 10-20% solvent when the molecular weight of the polymer decreases. Polymers of 5-80 melt index can be easily spun using ordinary melt spray equipment with 550 micron orifices. A simple hot-melt machine can be used to carry out this process.

In some cases, suitable solvents for a Hybrid composition may have high boiling points and low volatility. As such, the heating of the Hybrid composition will tend not to cause aggressive evaporation of the solvent (as contrasted with conventional solvent-based electrospinning in which solvents often have low boiling points and are highly volatile, thus reacting very aggressively to heat).

In some embodiments, suitable polymers may include low melt index polymers as well as polymers that have traditionally be considered to be "unspinnable" or extremely difficult to convert into fibers according to conventional teachings. For example, some suitable polymers may include polycarbonate (PC) and poly(vinylidene difluoride) (PVDF).

Note that the discussion herein with respect to Hybrid systems should not be confused with the discussion related to propylene carbonate solvent above even though the same acronym is used (PC) in both cases.

When using Hybrid compositions, it is believed that performance may be improved when the solvent is not particularly good at dissolving the polymer. By definition, the Hansen Solubility Parameters between a polymer of lower dielectric constant are not accurately matched to a solvent and additive mixture that have high or very high dielectric constants. The polarization parameter of the two materials is clearly and purposely not matched. In general, this also means that the dispersion and hydrogen bonding parameters are also generally not matched and possibly extremely poorly matched. For dielectrophoretic spinning, this is beneficial for achieving good results.

Moreover, in the Hybrid system, it is generally believed that the solvent is acting as a "lubricant" between polymer micelles, as opposed to fully dissolving the polymer (as in conventional polymer-solvent systems). This arrangement allows much less solvent to be used in Hybrid compositions than is normally required in conventional solvent-based electrospinning systems or even lower-temperature dielectrophoretic spinning systems. As such, it is beneficial to have a deliberate mismatch between the solvent and the polymer to encourage the formation of polymer micelles and to use heat to overcome this mismatch.

In some embodiments, various dielectrophoretic additives as generally described herein may also be added to the Hybrid compositions, and these may be used to for further reduce the size of particles that are formed.

Hybrid Experiment #1

In a first Hybrid experiment, a polymer solution was prepared that comprised 50% polycarbonate (PC) polymer (with a melt flow index of 80) dispersed in 50% dimethyl sulfoxide (DMSO) solvent.

The DMSO solvent was used as a functional dielectric additive and the spinning process was carried out using a conventional melt spray unit with four 550 micron diameter orifices in a 1" wide emitter. These orifices are located adjacent to slots that allow heated process air to emerge at elevated velocity to create a pre-fiber (pre-particle) that can be further attenuated within an electric field created by a circular electrode located in front of the orifices.

The solution was prepared by heating a vessel of DMSO to a temperature between 140-170 degrees Celsius. Next, the PC pellets were added gradually over time in such a manner that all the PC pellets dissolved in the DMSO and the solution remained in a liquid state before any subsequent PC pellets were added. The addition of PC pellets continued until the final solution composition (50% PC, 50% DMSO) was achieved.

It has been observed that if all or too many PC pellets are added to the DMSO at once, the PC pellets may not adequately dissolve and the mixture tends to remain paste-like, with some PC pellets being dissolved in the DMSO, while some PC pellets remaining un-dissolved. Adding all the PC pellets at once thus appears to be unsuitable for producing a uniform dispersion of PC in DMSO.

During the dielectrophoretic spinning of this composition, the operating conditions were generally as follows:

TABLE 22

Operating Conditions for Hybrid Experiment 1

| Parameter | Value |
|---|---|
| Voltage | 76 kV |
| Emitter-to-collector distance (DCD) | 18.5 cm |
| Process air temperature (Tp) | 200 deg. C. |
| Reservoir temperature (Tr) | 150 deg. C. |
| Temp. of external heat source (Text) | 500 deg. C. |
| Process air pressure (dp, p) | 30 psi |
| Reservoir air pressure (dp, r) | 3 psi |

For this experiment, the average diameter of the resulting fibers was approximately 299 nanometers. This average dropped to 258 nanometers if the largest 5% of the fibers were excluded from the sample. The standard deviation of the fibers was approximately 252 nanometers. Dry fiber production for the melt spray system is usually about 0.5 grams/orifice-minute This experiment was repeated with alternative mixtures of PC having a melt index as low as 10 dispersed into DMSO. One would ordinarily not expect PC to be spinnable into any kind of high-quality fiber, but even this low melt index grade was readily spun. What is particularly surprising here is that this result is achieved prior to the addition of more sophisticated additives and dispersants that can further drive fiber size down and production rates up.

Hybrid Experiment #2

A second experiment was conducted using a second composition that comprised a simple mixture of 25% polymer (K2850-04 P(VDF-HFP)) dispersed in 75% DMSO. The experimental setup was generally similar as to the first Hybrid experiment described above.

For this experiment, the average diameter of the resulting fibers was approximately 626 nanometers. This average dropped to 564 nanometers if the largest 5% of the particles were excluded from the sample. The standard deviation of the particles was approximately 385 nanometers.

What is particularly interesting about this second experiment is that it demonstrates that the production of PVDF nanofibers can be carried out using an ordinary melt spray machine with large orifices of 550 micron diameter. Hence, PVDF can be melt sprayed into nanofibers with a relatively un-complicated mixture. Additional dielectric additives and other enhancements can be used to drive fiber size downward and production rates up. However, even uncomplicated high dielectric contrast mixtures can be converted to nanofibers in this system.

Discussion of Hybrid Experiments

These results confirm that small particles can be formed using higher concentrations of polymers than were normally considered possible. In particular, the first example demonstrates that it is possible to form small polycarbonate particles using only 50% by weight solvent.

It is also notable that DMSO is not a particularly good solvent for PC. In particular, as discussed above, the PC pellets were added gradually over time under the application of heat to encourage the Hybrid composition to maintain a liquid state. When the PC pellets were added too quickly, the resulting mixture was non-homogeneous. This tends to support the conclusion that less than perfect solubility is not a barrier to forming small particles, and may in fact be connected to the mechanisms for high-quality particle formation.

It is also noted that the Hybrid compositions discussed herein may be suitable for use in other particle formation systems. In particular, it is believed that in addition to D-spinning these hybrid compositions, it may also be possible to electrospin suitable Hybrid compositions. In fact, such dispersions appear to be suitable for ordinary melt-blowing and spun bonding processes as well as direct filament extrusion into fiber. That is, these systems can be used to not only produce fibers with electrically-enhanced methods of attenuation, but can be used to produce a spin dope for other processes that are well known in the art. Here, it is not necessary to match or not match the dielectric properties of the polymer and solvent.

What is particularly useful is the application of a solvent that can handle the elevated temperature (without decomposing or causing excessive pressure) within the heating apparatus. A polymer of exceedingly high molecular weight can be processed in this fashion through conventional spinning equipment by using relatively minor amounts of solvent.

While the above description provides examples of one or more apparatus, methods, or compositions, it will be appreciated that other apparatus, methods, or compositions may be within the scope of the present description as interpreted by one of skill in the art.

The invention claimed is:

1. A high dielectric composition for particle formation, comprising: a high dielectric solvent having a dielectric constant above 15; a polymer of lower dielectric constant dissolved into the high dielectric solvent; and a high dielectric additive having a dielectric constant above 65; wherein at least one of the high dielectric solvent and the additive are dispersed within the composition using a dispersing agent.

2. The high dielectric composition of claim 1, wherein the polymer includes at least one of: a) polyvinylidene difluoride; b) polyvinylidene difluoride co- and ter-polymers; c) polyurethane; d) phenolic e) polyvinyl fluoride film; f) vinylidene difluoride-trifluoroethylene copolymer; g) polycaprolactone; and h) polycarbonate.

3. The high dielectric composition of claim 1 wherein the polymer concentration is between about 10 wt % and 25 wt %.

4. The high dielectric composition of claim 1 wherein the high dielectric additive includes at least one of: a) polyglycol; b) glycol; c) mannitol; d) ionic liquid; e) polyglycerol; f) glycerol; g) propylene carbonate; h) ethylene carbonate; i) titanium dioxide; j) barium titanate; k) calcium copper titanate l) lanthanum strontium nickelate nanopowder; m) samarium oxides; n) samarium titanates; o) lanthanum oxides; p) lanthanum titanates; q) strontium oxide; r) strontium titanates; s) nanopowders of metal, bi-metal, and multi-metal oxides or titanates; t) metals; u) surface functionalized nanoparticles; v) metal nanoparticles with an organic coating; w) iron carbonyl; x) conjugated polymers; y) liquid crystals; z) strontium-substituted lanthanum nickelate; and aa) nano-particles of metals including one or more of nickel, silver, aluminum, gold, transition metals including manganese, cobalt, and alloys including stainless steel.

5. The high dielectric composition of claim 1, wherein the solvent includes at least one of: a) acetone; b) acetonitrile; c) acetophenone; d) acetyl chloride; e) acrylonitrile; gamma-butyrolectone; g) cyclohexanone; h) N,N-dimethylacetamide; i) N,N-dimethylformamide; j) dimethylsulfoxide; k) 1,4-dioxane; l) ethylene glycol; m) ethyl formate; n) formamide; o) formic acid; p) methanol; q) methyl ethyl ketone; r) N-methyl-2-pyrrolidone; s) nitromethane; t) 2-nitropropane; u) propylene-1,2-carbonate; v) propylene carbonate; w) tetrahydrofuran; x) tetramethylurea; y) triethyl phosphate; and z) trimethyl phosphate.

6. The high dielectric composition of claim 1, wherein the dispersing agent includes at least one of: a) phosphonic acids; b) fluorous phosphonic acid; c) fluorophosphonic acid; d) Alkyltrimethoxysilanes; e) perfluorinated alkyltrimethoxysilanes; f) nonafluorohexyltrimethoxysilane; g) hydrocarbon sulfamates, sulfones, and sulfates; h) nonionic surfactants, including ethoxylates; and i) fluoro-surfactants.

7. The high dielectric composition of claim 1, wherein the polymer is dissolved into the solvent under the application of heat.

8. The high dielectric composition of claim 1, wherein the high dielectric solvent has a dielectric constant above 30.

9. The high dielectric composition of claim 1, wherein the high dielectric solvent has a dielectric constant above 45.

10. The high dielectric composition of claim 1, wherein the additive has a dielectric constant above 1000.

11. The high dielectric composition of claim 1, wherein the additive has a dielectric constant above 100,000.

* * * * *